US011450271B2

(12) United States Patent
Na

(10) Patent No.: US 11,450,271 B2
(45) Date of Patent: Sep. 20, 2022

(54) DISPLAY DEVICE

(71) Applicant: Samsung Display Co., Ltd., Yongin-si (KR)

(72) Inventor: Ji Su Na, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 7 days.

(21) Appl. No.: 17/078,001

(22) Filed: Oct. 22, 2020

(65) Prior Publication Data

US 2021/0125557 A1 Apr. 29, 2021

(30) Foreign Application Priority Data

Oct. 24, 2019 (KR) ..... 10-2019-0132761

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC .. G09G 3/3233; G09G 3/3266; G09G 3/3291; G09G 2300/0408; G09G 2300/0426; G09G 2300/0814; G09G 2300/0819; G09G 2300/0842; G09G 2300/0852; G09G 2300/0861; G09G 2320/045
See application file for complete search history.

(56) References Cited

U.S. PATENT DOCUMENTS

| | | | | |
|---|---|---|---|---|
| 10,658,452 | B2 | 5/2020 | Choi et al. | |
| 2012/0105410 | A1* | 5/2012 | Choi | G09G 3/3233 345/211 |
| 2015/0187270 | A1* | 7/2015 | Lee | G09G 3/3266 345/76 |
| 2017/0317156 | A1* | 11/2017 | Kim | H01L 27/3276 |
| 2018/0293939 | A1* | 10/2018 | Kim | H01L 27/3276 |
| 2019/0096330 | A1* | 3/2019 | Kim | G09G 3/3233 |
| 2019/0172888 | A1* | 6/2019 | Choi | H01L 27/3276 |
| 2019/0266941 | A1* | 8/2019 | Pyo | G06T 7/90 |

FOREIGN PATENT DOCUMENTS

| | | | |
|---|---|---|---|
| KR | 10-2012-0044504 | A | 5/2012 |
| KR | 10-2018-0114981 | A | 10/2018 |
| KR | 10-2019-0034375 | A | 4/2019 |

* cited by examiner

*Primary Examiner* — Stacy Khoo
(74) *Attorney, Agent, or Firm* — Lewis Roca Rothgerber Christie LLP

(57) ABSTRACT

A display device includes a display panel for driving a plurality of pixels. Each of the plurality of pixels includes: a light-emitting element; a driving transistor for controlling a driving current flowing through the light-emitting element; a first transistor for selectively applying a data voltage to a first node, a second transistor for receiving an emission signal from an emission control line to selectively apply a driving voltage to the first node; and a first capacitor connected between the first node and the emission control line. The first node is a source electrode of the driving transistor.

18 Claims, 24 Drawing Sheets

DISPLAY DEVICE

CROSS-REFERENCE TO RELATED APPLICATION

This application claims priority to and the benefit of Korean Patent Application No. 10-2019-0132761, filed on Oct. 24, 2020, in the Korean Intellectual Property Office, the disclosure of which is incorporated herein by reference in its entirety.

BACKGROUND

1. Field

Aspects of embodiment of the present disclosure relate to a display device.

2. Description of the Related Art

As the information-oriented society evolves, various demands for display devices are ever increasing. For example, display devices are being employed by (or in) a variety of electronic devices, such as smart phones, digital cameras, laptop computers, navigation devices, and smart televisions. Display devices may be flat panel display devices, such as a liquid-crystal display device, a field emission display device, and an organic light-emitting display device. Among such flat panel display devices, an organic light-emitting display device includes a light-emitting element so that each of the pixels of the display panel can emit light by themselves (e.g., such that each pixel can independently emit light). Accordingly, an organic light-emitting display device can display images without a backlight unit that supplies light to the display panel (e.g., the pixel of an organic light-emitting display device may be self-emissive).

An organic light-emitting display device generally includes a display panel having data lines, scan lines, a plurality of pixels connected to the respective data lines and scan lines, a data driver for applying data signals to the data lines, and a scan driver having a shift register for applying scan signals to the scan lines. The scan driver may supply scan signals to pixels according to a predetermined driving frequency. The scan driver may change the driving frequency when the display device is turned on or driven. In doing so, a flicker or ghost image may be displayed as the driving frequency of the display device changes.

SUMMARY

Aspects of the present disclosure provide a display device that can avoid or substantially avoid a flicker and/or ghost image that may be displayed when the driving frequency of the display device is changed by coupling the source electrode of the driving transistor using a gate-off voltage of an emission signal.

Aspects of the present disclosure also provide a display device that provides reduced power consumption by maintaining some of a plurality of signals supplied to a plurality of pixels at a high-speed driving (e.g., in a high-speed driving state or at a high driving frequency) while changing some other signals to a low-speed driving (e.g., to a low-speed driving state or to a low driving frequency).

It should be noted that aspects and features of the present disclosure are not limited to those mentioned above, and other aspects and features of the present disclosure will be apparent to those skilled in the art from the following descriptions.

According to an embodiment of the present disclosure, a display device includes a display panel for driving a plurality of pixels. Each of the plurality of pixels includes: a light-emitting element; a driving transistor for controlling a driving current flowing through the light-emitting element; a first transistor for selectively applying a data voltage to a first node, the first node being a source electrode of the driving transistor; a second transistor for receiving an emission signal from an emission control line to selectively apply a driving voltage to the first node; and a first capacitor connected between the first node and the emission control line.

Each of the plurality of pixels may further include: a third transistor for selectively connecting a second node with a third node, the second node being a drain electrode of the driving transistor, the third node being an anode electrode of the light-emitting element; and a fourth transistor for selectively applying a first initialization voltage to the third node.

The second transistor and the third transistor may be turned on in response to the emission signal having a first voltage level, and the fourth transistor may be turned on in response to the emission signal having a second voltage level that is higher than the first voltage level.

The driving transistor may include an active layer including a first material, and the fourth transistor may include an active layer including a second material different from the first material.

Each of the plurality of pixels may further include: a fifth transistor for selectively applying a second initialization voltage to a fourth node, the fourth node being a gate electrode of the driving transistor; and a sixth transistor for selectively connecting the second node with the fourth node.

Each of the driving transistor and the fourth transistor may include an active layer including a first material, and each of the fifth and sixth transistors may include an active layer including a second material different from the first material.

The display panel may include: a first active layer on a substrate and including a first material; a first gate layer on the first active layer; a second gate layer on the first gate layer; a second active layer on the second gate layer and including a second material different from the first material; a third gate layer on the second active layer; and a first source-drain layer on the third gate layer.

A first electrode of the first capacitor may be in the first gate layer, and a second electrode of the first capacitor may be in the second gate layer.

The display panel may further include a first connection electrode. The first connection electrode may be in the first source-drain layer, may be connected to the second electrode of the first capacitor through a first contact opening, and may be connected to the first node through a second contact opening. The first node may also being drain electrode of the second transistor.

The emission control line may include: a first emission control line in the first gate layer; and a second emission control line in the third gate layer. The first electrode of the first capacitor may be a part of the first emission control line that overlaps the second electrode.

A first electrode of the first capacitor may be in the third gate layer, and a second electrode of the first capacitor may be in the first source-drain layer.

The display panel may further include a second connection electrode. The second connection electrode may be in the first source-drain layer and may be connected to the first node through a third contact opening. The first node may also be a drain electrode of the second transistor.

The emission control line may include: a first emission control line in the first gate layer; and a second emission control line in the third gate layer. The first electrode of the first capacitor may be a part of the second emission control line that overlaps the second electrode.

A first electrode of the first capacitor may be in the first gate layer, and a second electrode of the first capacitor is in the second active layer.

The display panel may further include a third connection electrode. The third connection electrode may be in the first source-drain layer, may be connected to the second electrode of the first capacitor through a fourth contact opening, and may be connected to the first node through a fifth contact opening. The first node may also be a drain electrode of the second transistor.

The emission control line may include: a first emission control line in the first gate layer; and a second emission control line in the third gate layer. The first electrode of the first capacitor may be a part of the first emission control line that overlaps the second electrode.

According to an embodiment of the present disclosure, a display device includes a display panel for driving a plurality of pixels. Each of the plurality of pixels includes: a light-emitting element; a driving transistor for controlling a driving current flowing through the light-emitting element; a first transistor for selectively applying a data voltage to a first node, the first node being a source electrode of the driving transistor; a second transistor for receiving an emission signal from an emission control line to selectively apply a driving voltage to the first node; a third transistor for receiving the emission signal to selectively connect a second node with a third node, the second node being a drain electrode of the driving transistor, the third node being an anode electrode of the light-emitting element; and a first capacitor connected between the second node and the emission control line.

Each of the plurality of pixels may further include: a fourth transistor for selectively applying a first initialization voltage to the third node; a fifth transistor for selectively applying a second initialization voltage to a fourth node, the fourth node being a gate electrode of the driving transistor; and a sixth transistor for selectively connecting the second node with the fourth node.

The second transistor and the third transistor may be turned on in response to the emission signal having a first voltage level, and the fourth transistor may be turned on in response to the emission signal having a second voltage level that is higher than the first voltage level.

Each of the driving transistor and the fourth transistor may include an active layer including a first material, and each of the fifth and sixth transistors may include an active layer including a second material different from the first material.

According to an exemplary embodiment of the present disclosure, it is possible to achieve high-speed driving having a frequency that is a multiple of a frequency of scan signals by driving the scan signals such that they overlap each other. In a display device according to the exemplary embodiment of the present disclosure, some of the plurality of signals supplied to the plurality of pixels that are driven at high-speed may be maintained at high-speed driving while some other signals may be changed to low-speed driving. Each of the plurality of pixels may include a capacitor connected between the source electrode of the driving transistor and the emission control line. The capacitor may couple the voltage of the source electrode of the driving transistor when the emission signal transitions from a low level to a high level. Therefore, even when the driving frequency is changed, the display device may not experience flicker and/or ghost images by controlling the voltage at the source electrode of the driving transistor.

According to an exemplary embodiment of the present disclosure, each of the plurality of pixels may include a capacitor connected between the gate electrode of the driving transistor and the emission control line. The capacitor may couple the voltage of the drain electrode of the driving transistor when the emission signal transitions from a low level to a high level. In such an embodiment, the driving transistor may be turned on in response to the gate-on voltage, and the voltage at the drain electrode of the driving transistor may be transferred to the source electrode. Therefore, even when the driving frequency is changed, the display device may not experience flicker and/or ghost images by controlling the voltage at the source electrode of the driving transistor.

According to an exemplary embodiment of the present disclosure, it is possible to reduce the power consumption of the display device by maintaining some of the plurality of signals supplied to the plurality of pixels at high-speed driving while changing some other signals to low-speed driving.

It should be noted that the present disclosure is not limited to the aspects and features described above, and other aspects and features of the present disclosure will be apparent to those skilled in the art from the following description.

BRIEF DESCRIPTION OF THE DRAWINGS

The above and other aspects and features of the present disclosure will become more apparent by describing, in detail, exemplary embodiments thereof with reference to the attached drawings, in which.

DETAILED DESCRIPTION

Figure 1:
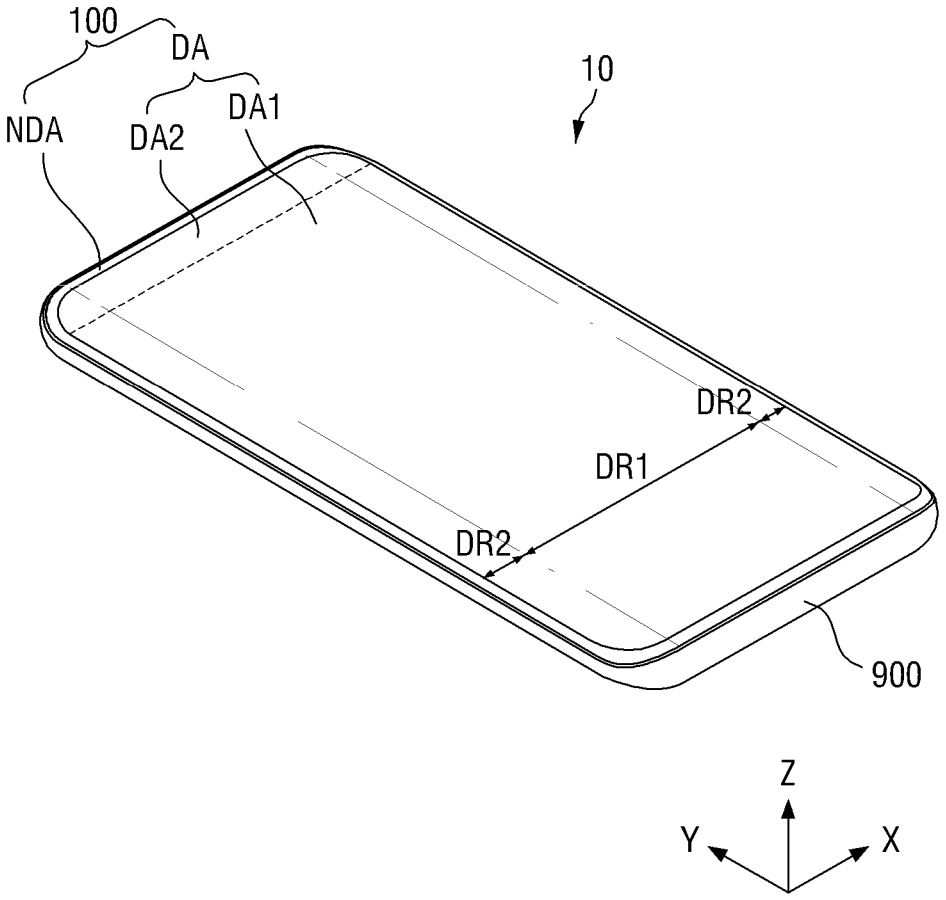
FIG. 1 is a perspective view showing a display device according to an exemplary embodiment of the present disclosure.

In the following description, for the purposes of explanation, numerous details are set forth in order to provide a thorough understanding of various exemplary embodiments (or implementations) of the present disclosure. As used herein, "embodiments" and "implementations" are interchangeable words that are non-limiting examples of devices or methods employing one or more of the inventive concepts disclosed herein. It is apparent, however, that various exemplary embodiments may be practiced without these details or with one or more equivalent arrangements. In other instances, well-known structures and devices may be shown in block diagram form to avoid unnecessarily obscuring various exemplary embodiments. Further, various exemplary embodiments may be different but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary (i.e., example) features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements") of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer or component, is referred to as being "on," "connected to," or "coupled to" another element, it may be directly on, connected to, or coupled to the other element or layer or intervening elements or layers may be present. When, however, an element is referred to as being "directly on," "directly connected to," or "directly coupled to" another element, there are no intervening elements present. To this end, the term "connected" may refer to physical, electrical, and/or fluid connection, with or without intervening elements.

Further, the X-axis, the Y-axis, and the Z-axis are not limited to three axes of a rectangular coordinate system, such as the x, y, and z axes, and may be interpreted in a broader sense. For example, the X-axis, the Y-axis, and the Z-axis may be perpendicular to one another or may represent different directions that are not perpendicular to one another. For the purposes of this disclosure, "at least one of X, Y, and Z" and "at least one selected from the group consisting of X, Y, and Z" may be construed as X only, Y only, Z only or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements would then be oriented "above" the other elements. Thus, the exemplary term "below" can encompass both an orientation of above and below. Furthermore, the apparatus may be otherwise oriented (e.g., rotated 90 degrees or at other orientations), and as such, the spatially relative descriptors used herein interpreted accordingly.

The terminology used herein is for the purpose of describing particular example embodiments and is not intended to be limiting. As used herein, the singular forms "a" and "an" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof but do not preclude the presence or addition of one or more other features, integers, steps, operations, elements, components, and/or groups thereof. It is also noted that, as used herein, the terms "substantially," "about," and other similar terms, are used as terms of approximation and not as terms of degree and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as being limited to the particular illustrated shapes of regions but include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
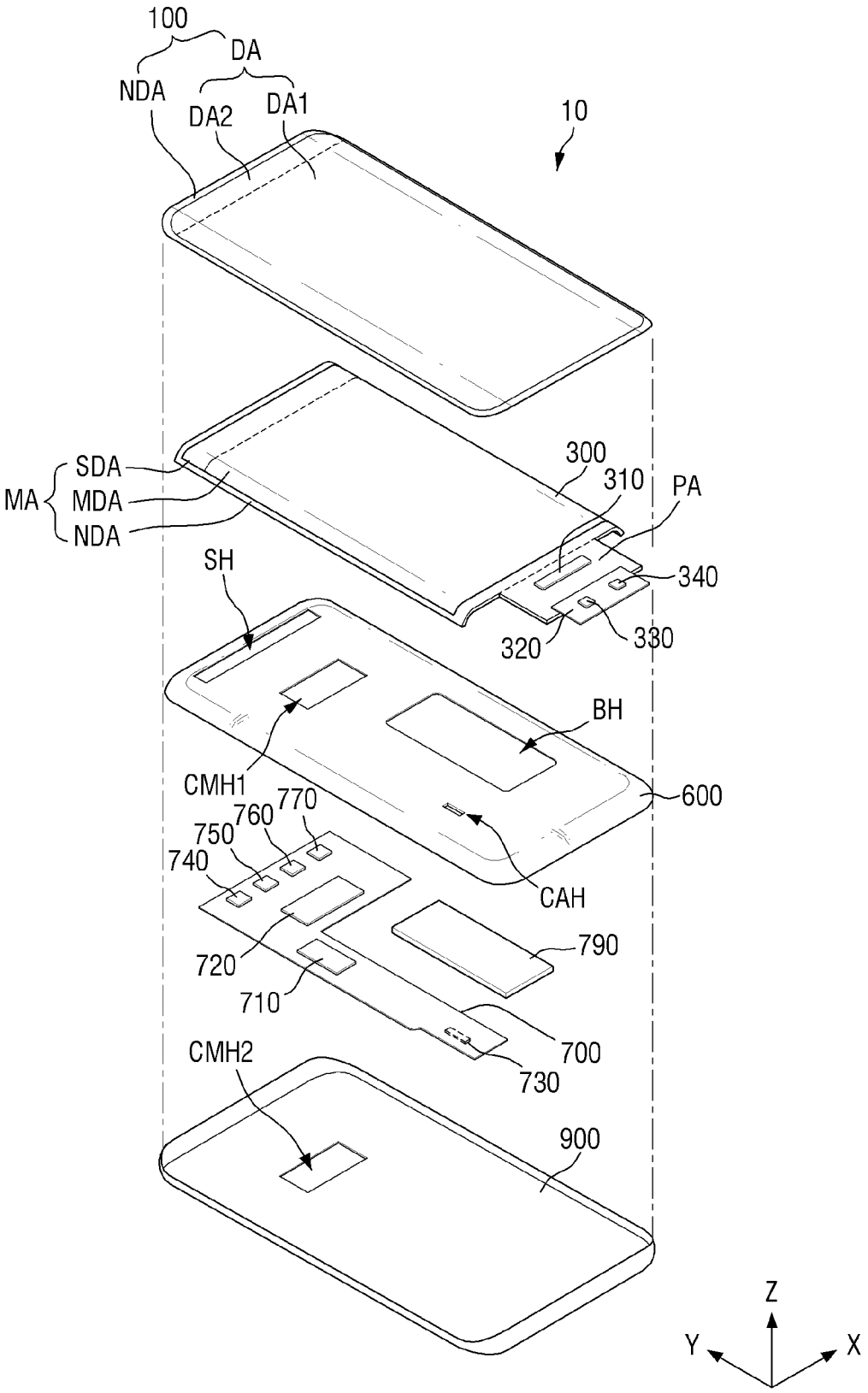
FIG. 2 is an exploded, perspective view of the display device shown in FIG. 1.

FIG. 1 is a perspective view showing a display device according to an exemplary embodiment of the present disclosure. FIG. 2 is an exploded, perspective view of the display device shown in FIG. 1.

Referring to FIGS. 1 and 2, a display device 10 according to an exemplary embodiment of the present disclosure may include a cover window 100, a display panel 300, a bracket 600, a main circuit board 700, and a bottom cover 900.

As used herein, the terms "above," "top," and "upper surface" refer to the upper side of the display device 10 (i.e., the side indicated by the arrow in the z-axis direction), whereas the terms "below," "bottom," and "lower surface" refer to the lower side of the display device 10 (i.e., the opposite side in the z-axis direction). As used herein, the terms "left," "right," "upper," and "lower" sides indicate relative positions when the display device 10 is viewed from the top. For example, the "left side" refers to the opposite direction indicated by the arrow of the x-axis (i.e., the −x direction), the "right side" refers to the direction indicated by the arrow of the x-axis, the "upper side" refers to the direction indicated by the arrow of the y-axis, and the "lower side" refers to the opposite direction indicated by the arrow of the y-axis (i.e., the −y direction).

The display device 10 is configured to display video and/or still image. The display device 10 may be used as the display screen of portable electronic devices, such as a mobile phone, a smart phone, a tablet PC, a smart watch, a watch phone, a mobile communications terminal, an electronic notebook, an electronic book, a portable multimedia player (PMP), a navigation device, and an ultra mobile PC (UMPC), as well as the display screen of various products, such as a television, a laptop computer, a monitor, a billboard, and an Internet of Things device.

The display device 10 may have a rectangular shape when viewed from the top. For example, the display device 10 may have a rectangular shape having shorter sides in a first direction (x-axis direction) and longer sides in a second direction (y-axis direction) when viewed from the top as shown in FIGS. 1 and 2. Each of the corners at where the short side in the first direction (x-axis direction) meets the longer side in the second direction (y-axis direction) may be rounded with a curvature (e.g., a predetermined curvature) or may be a right angle. The shape of the display device 10 when viewed from the top is not limited to a rectangular shape, and the display device 10 may be formed in another shape, such as a polygonal shape, a circular shape, or an elliptical shape.

The display device 10 may include a first area DR1 which is formed flat, and second areas DR2 extending from the right and left sides of the first area DR1, respectively. The second areas DR2 may be formed flat or may be curved. When the second areas DR2 are formed flat, the angle formed between the first area DR1 and each of the second areas DR2 may be an obtuse angle. When the second areas DR2 are formed as curved surfaces, they may have a constant curvature or a varying curvature.

Although the second areas DR2 are extended from the left and right sides of the first area DR1, respectively, in FIG. 1, this is merely illustrative. For example, the second area DR2 may extend from only one of the right and left sides of the first area DR1. In other embodiments, the second areas DR2 may extend from at least one of upper and lower sides of the first area DR1, as well as the left and right sides. In the following description, the second areas DR2 are disposed at the left and right edges of the display device 10, respectively, as an example.

The cover window 100 may be disposed on the display panel 300 to cover the upper surface of the display panel 300. The cover window 100 can protect the upper surface of the display panel 300.

The cover window 100 may be disposed in the first area DR1 and the second areas DR2. The cover window 100 may include a first transmissive portion DA1 and a second transmissive portion DA2 covering the display panel 300 and a non-transmissive portion NDA covering portions other than the display panel 300. The second transmissive portion DA2 may be disposed on one side of the first transmissive portion DA1, for example, on the upper side as shown in FIGS. 1 and 2. The first transmissive portion DA1 and the second transmissive portion DA2 may be disposed in the first area DR1 and the second areas DR2. The non-transmissive portion NDA may be opaque. In other embodiments, the non-transmissive portion NDA may be formed as a decoration layer having a pattern that can be displayed to (e.g., visible to) a user when no image is displayed.

The display panel 300 may be disposed under the cover window 100. The display panel 300 may be disposed in the first area DR1 and the second areas DR2. Therefore, images displayed by the display panel 300 can be seen not only in the first area DR1 but also in the second areas DR2 through the cover window 100. For example, images displayed by the display panel 300 can be seen from the upper surface and the left and right edges of the display device 10 through the cover window 100.

The display panel 300 may be a light-emitting display panel including light-emitting elements. For example, the display panel 300 may be an organic light-emitting display panel including organic light-emitting diodes having an organic emissive layer, a micro light-emitting diode display panel including micro LEDs, a quantum-dot light-emitting display panel including quantum-dot light-emitting diodes having a quantum-dot emissive layer, or an inorganic light-emitting display panel including inorganic light-emitting elements including an inorganic semiconductor. In the following description, the display panel 300 is described as an organic light-emitting display panel as an example.

The display panel 300 may include a main area MA and a protruding area PA protruding from one side of the main area MA.

The main area MA may have a general area MDA, a sensor area SDA, and a non-display area NDA.

The general area MDA may be disposed to overlap with the first transmissive portion DA1 of the cover window 100. The sensor area SDA may be disposed to overlap with the second transmissive portion DA2 of the cover window 100. The sensor area SDA may be disposed on, but is not limited to, one side of the general area MDA, for example, the upper side as shown in FIG. 2. As another example, the sensor area SDA may be disposed to be surrounded by (e.g., surrounded along a periphery by) the general area MDA and/or may be disposed adjacent to a corner of the display panel 300. In addition, although the display panel 300 includes one sensor area SDA in the example shown in FIG. 2, this is merely illustrative. For example, the display panel 300 may include a plurality of sensor areas SDA.

Each of the general area MDA and the sensor area SDA may include a plurality of pixels, scan lines and data lines connected to the plurality of pixels, and a power supply line.

The non-display area NDA may be defined as an edge area of the display panel 300. The non-display area NDA may include a scan driver for applying scan signals to the scan lines and link lines connecting the data lines with a display driving circuit 310.

The protruding area PA may protrude from one side of the main area MA. In the example shown in FIG. 2, the protruding area PA may protrude from the lower side of the general area MDA. For example, the length of the protruding area PA in the first direction (x-axis direction) may be smaller than the length of the main area MA in the first direction (x-axis direction).

The protruding area PA may include a bending area and a pad area. The pad area may be disposed on one side of the bending area, and the main area MA may be disposed on the opposite side of the bending area. For example, the pad area may be disposed on the lower side of the bending area, and the main area MA may be disposed on the upper side of the bending area.

The display panel 300 (e.g., the protruding area PA) may be formed to be flexible so that it can be curved, bent, folded, or rolled. For example, the display panel 300 (e.g., the protruding area PA) may be bent at the bending area in the thickness direction (z-axis direction).

The display panel 300 may include a display driving circuit 310, a circuit board 320, a power supply 330, and a touch driving circuit 340.

The display driving circuit 310 may output signals and voltages for driving the display panel 300. For example, the display driving circuit 310 may apply data voltages to the data lines. In addition, the display driving circuit 310 may apply driving voltage to the power lines and may apply scan control signals to the scan driver.

The circuit board 320 may be attached to the pads by using an anisotropic conductive film (ACF). In addition, the lead lines of the circuit board 320 may be electrically connected to the pads of the display panel 300. For example, the circuit board 320 may be a flexible printed circuit board (FPCB), a printed circuit board (PCB), or a flexible film, such as a chip-on-film (COF).

The power supply 330 may be disposed on the circuit board 320 to apply driving voltages to the display driving circuit 310 and the display panel 300. For example, the power supply 330 may generate a driving voltage to be applied to a driving voltage line and may generate a low-level voltage to be applied to the cathode electrode of the light-emitting element of each of the sub-pixels. For example, the driving voltage may be a high-level voltage for driving a light-emitting element, e.g., an organic light-emitting diode, and the low-level voltage may be a low-level voltage for driving the organic light-emitting diode.

The touch driving circuit 340 may be disposed on the circuit board 320 to measure capacitance of the touch electrodes. For example, the touch driving circuit 340 may determine whether or not there is a user's touch and the position of the user's touch, if any, based on a change in the capacitance of the touch electrodes. As used herein, a user's touch refers to an object, such as the user's finger or a pen, contacting a surface of the display device 10 at where the touch sensing layer is disposed. The touch driving circuit 340 can determine the position of the user's touch by distinguishing some of the touch electrodes where the user's touch occurs from the others.

The bracket 600 may be disposed under the display panel 300. The bracket 600 may include plastic, metal, or a combination thereof. For example, the bracket 600 may include a first camera opening (e.g., a first camera hole) CMH1 into which a first camera sensor 720 is inserted, a battery opening (e.g., a battery hole) BH in which a battery is disposed, a cable opening (e.g., a cable hole) CAH through which cables connected to the display driving circuit 310 or the circuit board 320 pass, and a sensor opening (e.g., a sensor hole) SH in which sensor devices 740, 750, 760 and 770 are disposed. As another example, the bracket 600 may not include the sensor opening SH and may not be overlap the sensor area SDA of the display panel 300.

The main circuit board 700 and the battery 790 may be disposed under the bracket 600. The main circuit board 700 may be either a printed circuit board (PCB) or a flexible printed circuit board.

The main circuit board 700 may include a main processor 710, a first camera sensor 720, a main connector 730, and sensor devices 740, 750, 760 and 770. The first camera sensor 720 may be disposed on both the upper and lower surfaces of the main circuit board 700, the main processor 710 may be disposed on the upper surface of the main circuit board 700, and the main connector 730 may be disposed on the lower surface of the main circuit board 700. The sensor devices 740, 750, 760 and 770 may be disposed on the upper surface of the main circuit board 700.

The main processor 710 may control all (or substantially all) of the functions of the display device 10. For example, the main processor 710 may apply digital video data to the display driving circuit 310 so that the display panel 300 displays an image. The main processor 710 may receive touch data from the touch driving circuit 340 to determine the coordinates of the user's touch and may then execute an application indicated by the icon displayed at the coordinates of the user's touch.

The main processor 710 may control the display device 10 based on sensor signals input from the sensor devices 740, 750, 760 and 770. For example, the main processor 710 may determine whether or not an object is located near the upper surface of the display device 10 based on a proximity sensor signal input from a proximity sensor 740. In a call mode, even if an object is proximate to the upper surface of the display device 10 such that a user's touch is made, the main processor 710 may not execute the application indicated by the icon displayed at the coordinates of the user's touch.

The main processor 710 may determine the brightness of the upper surface of the display device 10 according to an illuminance sensor signal input from an illuminance sensor 750. The main processor 710 may adjust the luminance of an image displayed by the display panel 300 depending on the brightness of the upper surface of the display device 10.

The main processor 710 may determine whether or not a user's iris image is identical to as the iris image previously stored in a memory based on an iris sensor signal input from the iris sensor 760. When it is determined that the user's iris image is identical (or substantially identical) to the iris image previously stored in the memory, the main processor 710 may unlock the display device 10 to display a home screen on the display panel 300.

The first camera sensor 720 may process image frames, such as still image and video obtained by an image sensor and may output them to the main processor 710. For example, the first camera sensor 720 may be, but is not limited to, a CMOS image sensor or a CCD sensor. The first camera sensor 720 may be exposed to the lower surface of the bottom cover 900 through a second camera opening (e.g., a second camera hole) CMH2 and may capture an object or a background under the display device 10.

A cable having passed through the cable opening CAH of the bracket 600 may be connected to the main connector 730. Accordingly, the main circuit board 700 may be electrically connected to the display driving circuit 310 and/or the circuit board 320.

The sensor devices may include the proximity sensor 740, the illuminance sensor 750, the iris sensor 760, and a second camera sensor 770.

The proximity sensor 740 may detect whether or not an object is proximate to the upper surface of the display device 10. For example, the proximity sensor 740 may include a light source that outputs light and a light receiver that receives light reflected by an object. The proximity sensor 740 is configured to determine whether or not there is an object proximate to the upper surface of the display device 10 based on the amount of light reflected by the object. The proximity sensor 740 overlaps the sensor opening SH, the sensor area SDA of the display panel 300, and the second transmissive portion DA2 of the cover window 100 in the thickness direction (z-axis direction) of the display panel 300. Therefore, the proximity sensor signal may be generated and output to the main processor 710 when there is an object proximate to the upper surface of the display device 10.

The illuminance sensor 750 is configured to detect the brightness of the upper surface of the display device. The illuminance sensor 750 may include a resistor whose resistance changes depending on the brightness of incident light. The illuminance sensor 750 may determine the brightness of the upper surface of the display device based on the resistance of the resistor. The illuminance sensor 750 overlaps the sensor opening SH, the sensor area SDA of the display panel 300, and the second transmissive portion DA2 of the cover window 100 in the thickness direction (z-axis direction) of the display panel 300. Therefore, the illuminance sensor signal may be generated and output to the main processor 710 depending on the brightness of the upper surface the display device.

The iris sensor 760 is configured to determine whether or not the captured image of the user's iris is identical (or substantially identical) to the iris image previously stored in the memory. The iris sensor 760 may generate and output an iris sensor signal to the main processor 710 depending on whether or not the image of the user's iris is identical to the iris image previously stored in the memory.

The second camera sensor 770 may process image frames, such as still image and video obtained by an image sensor and may output them to the main processor 710. For example, the second camera sensor 770 may be, but is not limited to, a CMOS image sensor or a CCD sensor. The number of pixels of the second camera sensor 770 may be smaller than the number of pixels of the first camera sensor 720, and the size of the second camera sensor 770 may be smaller than that of the first camera sensor 720. The second camera sensor 770 overlaps the sensor opening SH, the sensor area SDA of the display panel 300, and the second transmissive portion DA2 of the cover window 100 in the thickness direction (z-axis direction) of the display panel 300. Therefore, the second camera sensor 770 may capture an object or a background above the display device 10.

The battery 790 may be disposed so that it does not overlap the main circuit board 700 in the third direction (z-axis direction). The battery 790 may overlap with the battery opening BH of the bracket 600.

The main circuit board 700 may further include a mobile communications module configured to transmit/receive a wireless signal to/from at least one of a base station, an external terminal, and a server over a mobile communications network. The wireless signal may include various types (or kinds) of data depending on a voice signal, a video call signal, or a text/multimedia message transmission/reception.

The bottom cover 900 may be disposed under the main circuit board 700 and the battery 790. The bottom cover 900 may be fastened and fixed to the bracket 600. The bottom cover 900 may form the exterior of the lower surface of the display device 10. The bottom cover 900 may be made of plastic, metal, or a combination thereof The bottom cover 900 may include the second camera opening CMH2 via which the lower surface of the first camera sensor 720 is exposed. The position of the first camera sensor 720 and the positions of the first and second camera opening CMH1 and CMH2 in line with the first camera sensor 720 are not limited to those according to the exemplary embodiment shown in FIG. 2.

Figure 3:
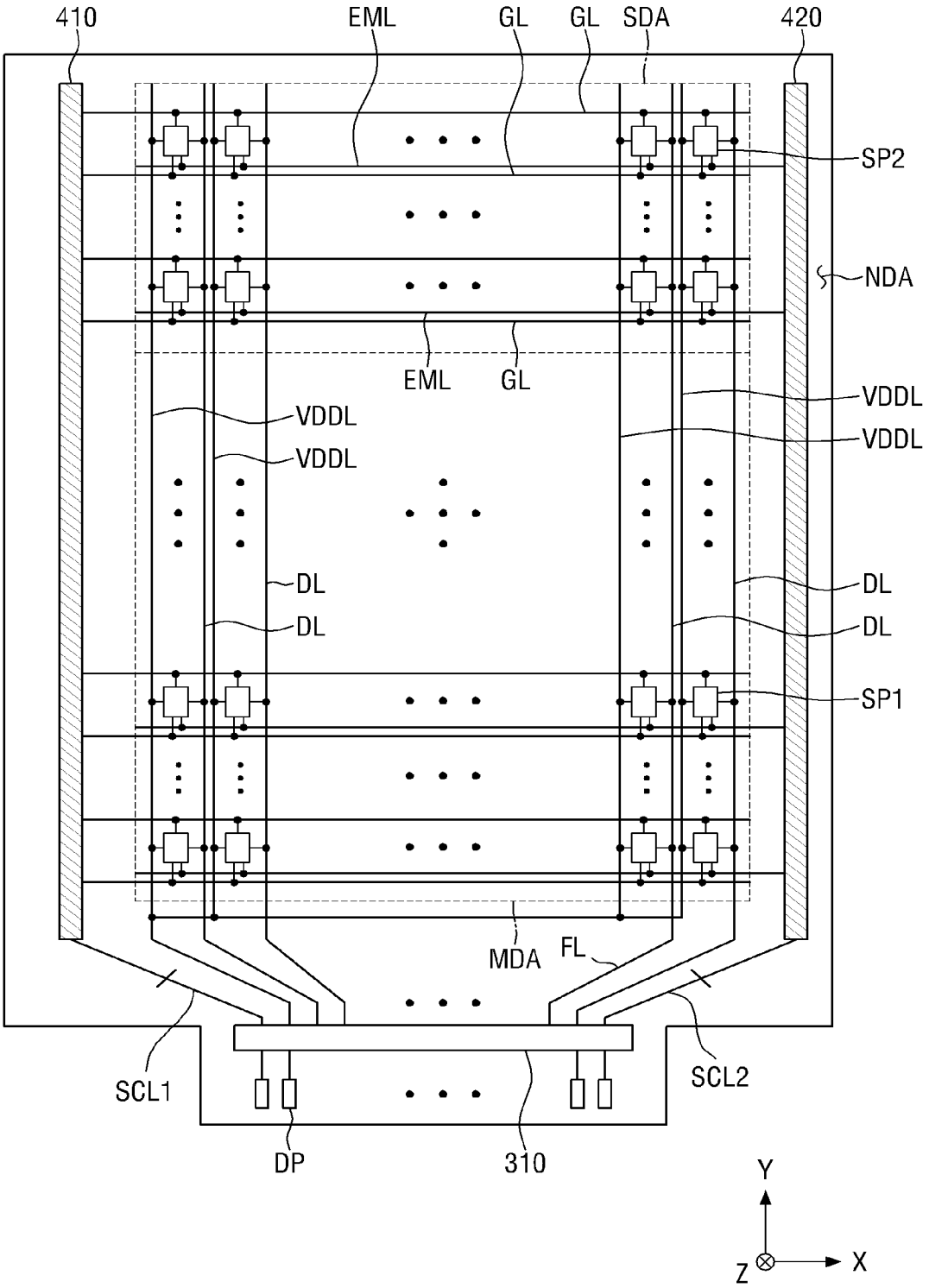
FIG. 3 is a plan view showing the display panel shown in FIGS. 1 and 2.
Figure 4:
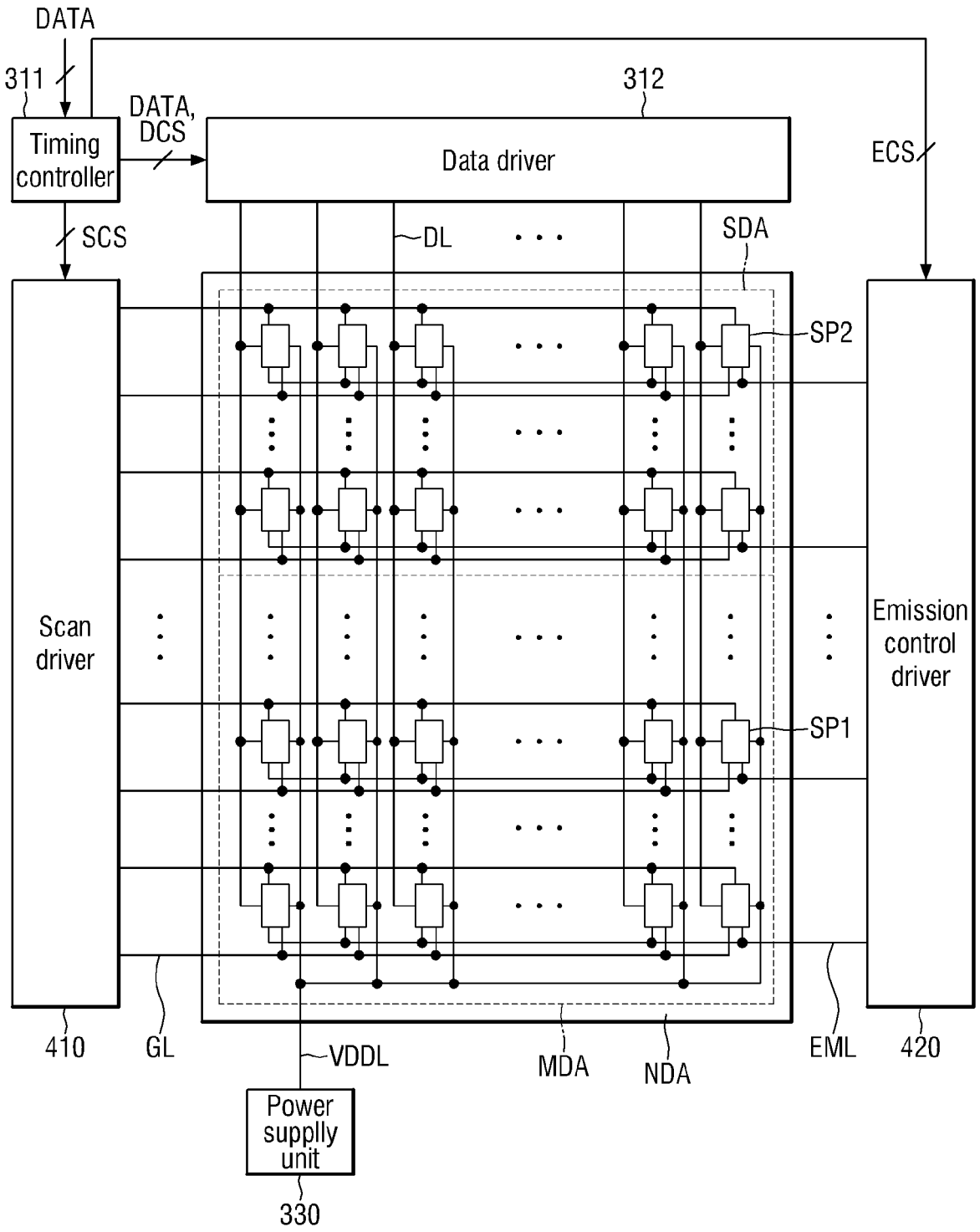
FIG. 4 is a block diagram showing the display panel and a display driving circuit according to an exemplary embodiment of the present disclosure.

FIG. 3 is a plan view showing the display panel shown in FIGS. 1 and 2, and FIG. 4 is a block diagram showing the display panel and a display driving circuit according to an exemplary embodiment of the present disclosure.

Referring to FIGS. 3 and 4, the display panel 300 may include the general area MDA, the sensor area SDA, and the non-display area NDA.

The general area MDA may include first sub-pixels SP1, driving voltage lines VDDL connected to the first sub-pixels SP1, scan lines GL, emission control lines EML, and data lines DL.

Each of the first sub-pixels SP1 may be connected to at least one scan line GL, at least one data line DL, at least one emission control line EML, and at least one driving voltage line VDDL. Although each of the first sub-pixels SP1 is shown as being connected to two scan lines GL, one data line DL, one emission control line EML and one driving voltage line VDDL in the example shown in FIGS. 3 and 4, the present disclosure is not limited thereto. For example, each of the first sub-pixels SP1 may be connected to three or more scan lines GL.

Each of the first sub-pixels SP1 may include a driving transistor, a switching transistor, a light-emitting element, and a capacitor.

The first sub-pixels SP1 may receive the driving voltage VDD through the driving voltage lines VDDL. The driving voltage VDD may be a high-level voltage for driving the light-emitting elements of the first sub-pixels SP1.

The scan lines GL and emission control lines EML may extend in the first direction (x-axis direction) and may be spaced apart from one another in the second direction (y-axis direction) crossing (e.g., perpendicular to) the first direction (x-axis direction).

The data lines DL may extend in the second direction (y-axis direction) and may be spaced apart from one another in the first direction (x-axis direction).

The sensor area SDA may include second sub-pixels SP2, driving voltage lines VDDL connected to the second sub-pixels SP2, scan lines GL, emission control lines EML, and data lines DL.

Each of the second sub-pixels SP2 may be connected to at least one scan line GL, at least one data line DL, at least one emission control line EML, and at least one driving voltage line VDDL. Although each of the second sub-pixels SP2 is shown as being connected to two scan lines GL, one data line DL, one emission control line EML and one driving voltage line VDDL in the example shown in FIGS. 3 and 4, the present disclosure is not limited thereto. For example, each of the second sub-pixels SP2 may be connected to three or more scan lines GL.

Each of the second sub-pixels SP may include a driving transistor, a switching transistor, a light-emitting element, and a capacitor.

The second sub-pixels SP2 may receive the driving voltage VDD through the driving voltage lines VDDL. The driving voltage VDD may be a high-level voltage for driving the light-emitting elements of the second sub-pixels SP2.

For example, the number of first sub-pixels SP1 per unit area in the general area MDA may be greater than the number of second sub-pixels SP2 per unit area in the sensor area SDA. The general area MDA is for displaying images, which is the main function of the display device 10, and the first sub-pixels SP1 may be densely arranged therein. The sensor area SDA may include a pixel area in which the second sub-pixels SP2 are disposed and a transmissive area that transmits light. Therefore, as the area of the transmissive area of the sensor area SDA is increased, the number of second sub-pixels SP2 per unit area may be smaller than the number of first sub-pixels SP1 per unit area.

The non-display area NDA may be defined as the remaining area of the display panel 300 except for the general area MDA and the sensor area SDA. The non-display area NDA may include a scan driver 410 for applying scan signals to the scan lines GL, fan-out lines FL connecting the data lines DL with the display driving circuit 310, and pads DP connected to the circuit board 320. The display driving circuit 310 and the pads DP may be disposed in the pad area of the display panel 300. The pads DP may be disposed closer to one edge of the pad area than the display driving circuit 310.

As shown in FIG. 4, the display driving circuit 310 may include a timing controller 311 and a data driver 312.

The timing controller 311 may receive digital video data DATA and timing signals from the circuit board 320. The timing controller 311, based on the timing signals, may generate a scan control signal SCS to control the operation timing of the scan driver 410, may generate an emission control signals ECS to control the operation timing of the emission control driver 420, and may generate a data control signals DCS to control the operation timing of the data driver 312. The timing controller 311 may output the scan control signal SCS to the scan driver 410 through a first scan control line SCL1. The timing controller 311 may output the emission control signal ECS to the emission control driver 420 through a second scan control line SCL2. The timing controller 311 may output the digital video data DATA and the data control signal DCS to the data driver 312.

The data driver 312 may convert the digital video data DATA into analog positive/negative data voltages and may supply them to the data lines DL through the fan-out lines FL. The scan signals of the scan driver 410 may be used to select sub-pixels SP to which a data voltage is applied, and the selected sub-pixels SP may receive the data voltage through the data lines DL.

In FIG. 3, the scan driver 410 may be disposed on an outer side of the general area MDA and the sensor area SDA or on one side of the non-display area NDA. The emission control driver 420 may be disposed on another outer side of the general area MDA and the sensor area SDA or on the opposite side of the non-display area NDA. For another example, both the scan driver 410 and the emission control driver 420 may be disposed on an outer side of the general area MDA and the sensor area SDA.

The scan driver 410 may include a plurality of thin-film transistors for generating scan signals based on the scan control signal SCS, and the emission control driver 420 may include a plurality of thin-film transistors for generating emission signals based on the emission control signal ECS. For example, the thin-film transistors of the scan driver 410 and the thin-film transistors of the emission control driver 420 may be formed on the same layer as the thin-film transistors of each of the first and second sub-pixels SP1 and SP2.

Figure 5:
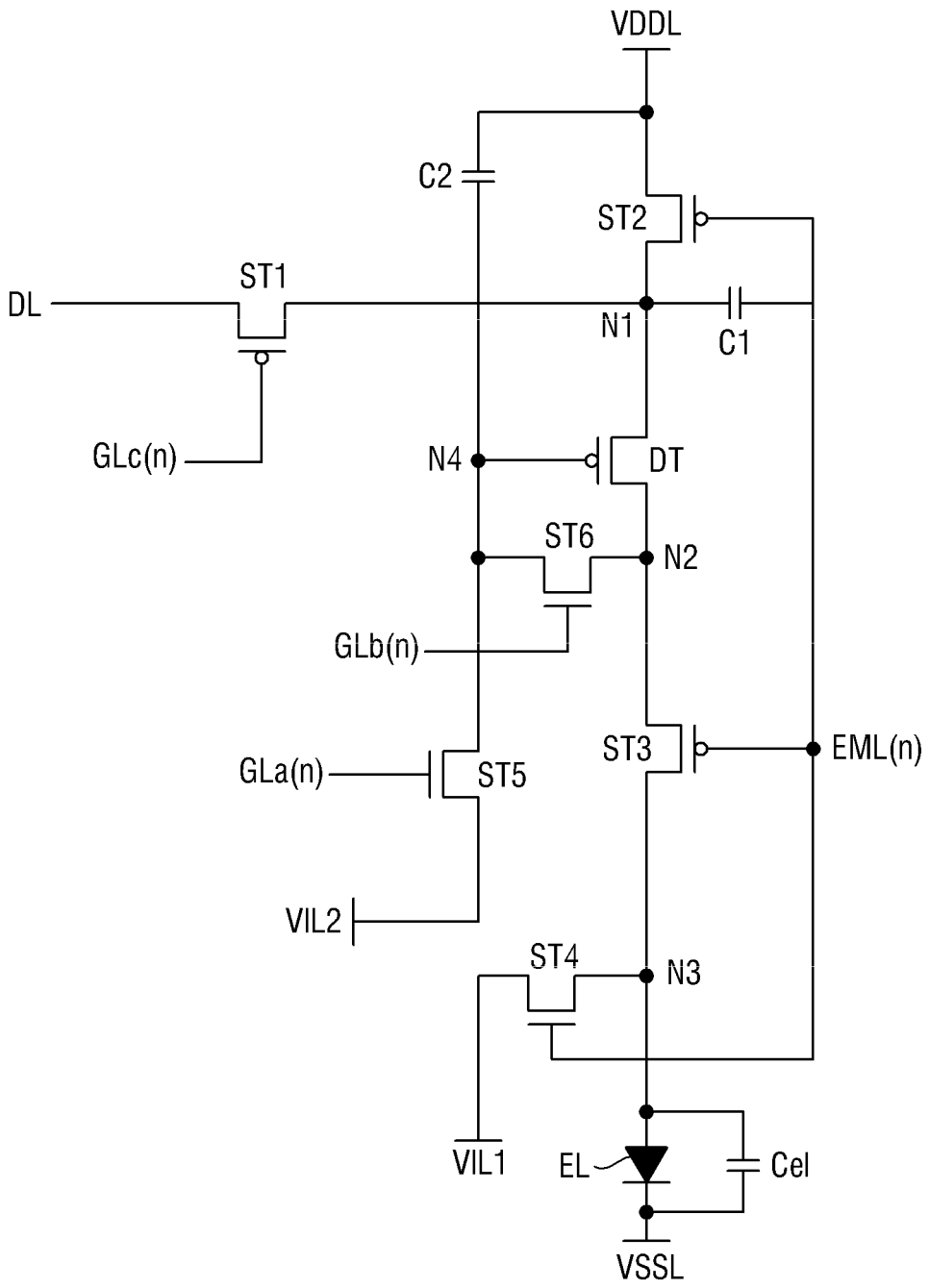
FIG. 5 is a circuit diagram showing a sub-pixel according to an exemplary embodiment of the present disclosure.
Figure 6:
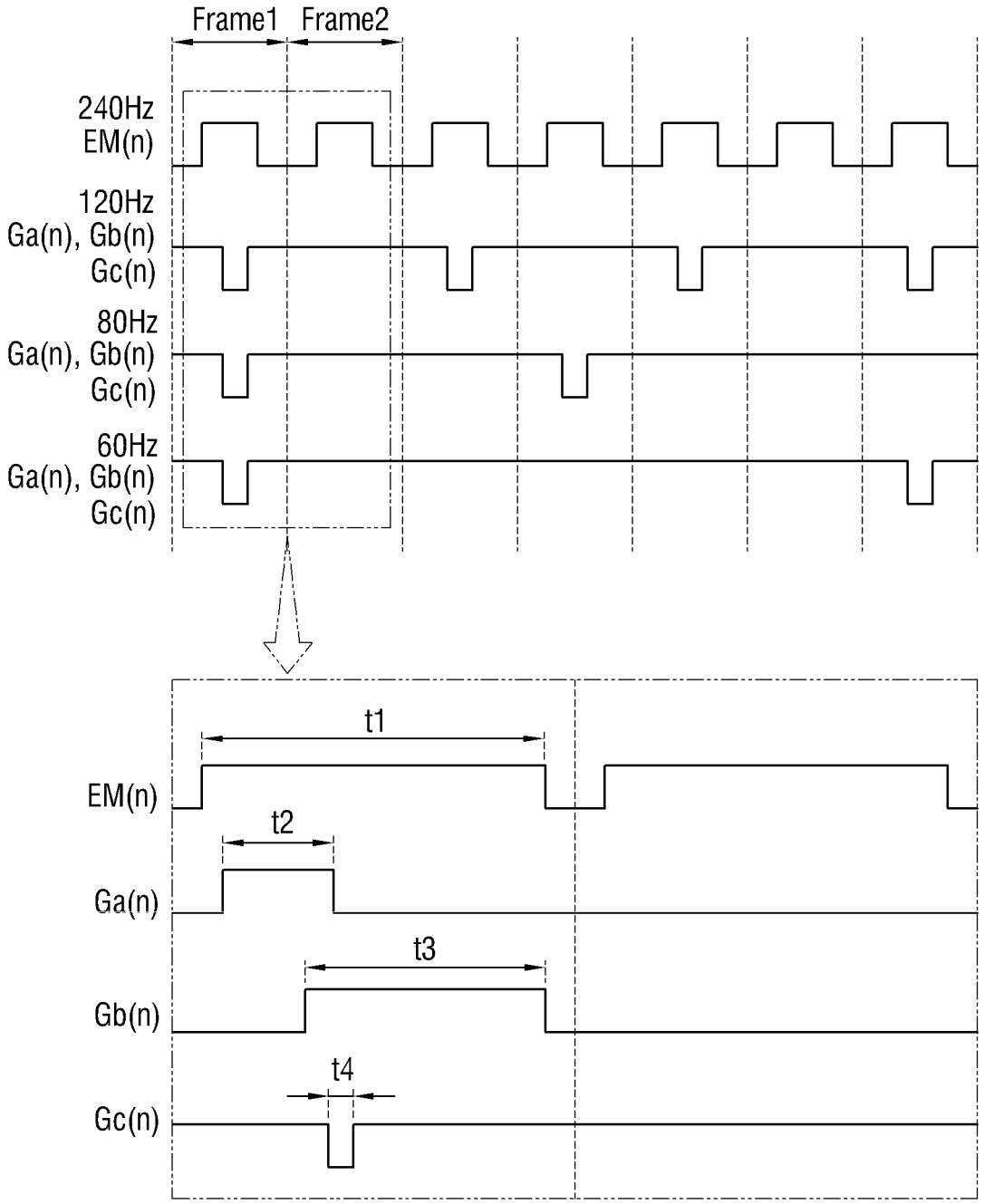
FIG. 6 is a waveform diagram of signals supplied to the sub-pixel shown in FIG. 5.

FIG. 5 is a circuit diagram showing a sub-pixel according to an exemplary embodiment of the present disclosure, and FIG. 6 is a waveform diagram of signals supplied to the sub-pixel shown in FIG. 5. The sub-pixel shown in FIG. 5 may be the first sub-pixel SP1 or the second sub-pixel SP2 shown in FIGS. 3 and 4.

Referring to FIGS. 5 and 6, the display panel 300 may include a plurality of sub-pixels arranged along p rows and q columns, where p and q are natural numbers. A sub-pixel disposed in $n^{th}$ row and $m^{th}$ column may be connected to a first scan line GLa(n), a second scan line GLb(n), and a third scan line GLc(n), an emission control line EML(n), a data line DL, a driving voltage line VDDL, and first and second initialization voltage lines VIL1 and VIL2, where n is a natural number equal to or less than p, and m is a natural number equal to or less than q. For example, the emission control line EML(n) may include first and second emission control lines. The first emission control line may supply an emission signal to second and third transistors ST2 and ST3, each including an active layer including (or made of) a first material, and the second emission control line may supply an emission signal to a fourth transistor ST4 including an active layer including (or made of) a second material different from the first material. The second and third transistors ST2 and ST3 may be turned on at a first voltage level of the emission signal, and the fourth transistor ST4 may be turned on at a second voltage level higher than the first voltage level of the emission signal.

The sub-pixel SP may include a driving transistor DT, a light-emitting element EL, a plurality of switching elements, and first and second capacitors C1 and C2. The switching elements may include first to sixth transistors ST1, ST2, ST3, ST4, ST5 and ST6.

The driving transistor DT may include a gate electrode, a source electrode, and a drain electrode. The driving transistor DT may control the source-drain current Isd (hereinafter, referred to as "driving current") according to the data voltage applied to the gate electrode. The driving current Isd flowing through the channel of the driving transistor DT may be proportional to the square of the difference between the threshold voltage Vth and the voltage Vsg between the source electrode and the gate electrode of the driving transistor DT ($Isd=k'\times(Vsg-Vth)^2$), where k' denotes a proportional coefficient determined by the structure and physical properties of the driving transistor DT, Vsg denotes the source-gate voltage of the driving transistor DT, and Vth denotes the threshold voltage of the driving transistor DT.

The light-emitting element EL may receive a driving current to emit light. The amount or the brightness of the light emitted from the light-emitting element EL may be proportional to the magnitude of the driving current.

The light-emitting element EL may be an organic light-emitting diode including an anode electrode, a cathode electrode, and an organic emissive layer disposed between the anode electrode and the cathode electrode. In other embodiments, the light-emitting element EL may be an inorganic light-emitting element including an anode electrode, a cathode electrode, and an inorganic semiconductor disposed between the anode electrode and the cathode electrode. In other embodiments, the light-emitting element EL may be a quantum-dot light-emitting element including an anode electrode, a cathode electrode, and a quantum-dot emissive layer disposed between the anode electrode and the cathode electrode. In other embodiments, the light-emitting element EL may be a micro light-emitting diode.

The anode electrode of the light-emitting element EL may be connected to a third node N3. The anode electrode of the light-emitting element EL may be connected to the drain electrode of the third transistor ST3 and the source electrode of the fourth transistor T4 through the third node N3. The cathode electrode of the light-emitting element EL may be connected to the low-level line VSSL. A parasitic capacitance Cel may be formed between the anode electrode and the cathode electrode of the light-emitting element EL.

The first transistor ST1 may be turned on by a third scan signal Gc(n) of the third scan line GLc(n) and may connect the data line DL with the first node N1, i.e., the source electrode of the driving transistor DT. The first transistor ST1 may be turned on based on the third scan signal Gc(n), thereby applying a data voltage to the first node N1. The gate electrode of the first transistor ST1 may be connected to the third scan line GLc(n), the source electrode thereof may be connected to the data line DL, and the drain electrode thereof may be connected to the first node N1. The drain electrode of the first transistor ST1 may be electrically connected to the source electrode of the driving transistor DT, the drain electrode of the second transistor ST2, and the second electrode of the first capacitor C1 through the first node N1.

The second transistor ST2 may be turned on by an emission signal of the emission control line EML(n) and may connect the driving voltage line VDDL with the first node N1, i.e., the source electrode of the driving transistor DT. The gate electrode of the second transistor ST2 may be connected to the emission control line EML(n), the source electrode thereof may be connected to the driving voltage line VDDL, and the drain electrode thereof may be connected to the first node N1. The drain electrode of the second transistor ST2 may be electrically connected to the source electrode of the driving transistor DT, the drain electrode of the first transistor ST1, and the second electrode of the first capacitor C1 through the first node N1.

The third transistor ST3 may be turned on by the emission signal of the emission control line EML(n) to connect the second node N2, i.e., the drain electrode of the driving transistor DT with the third node N3, i.e., the anode electrode of the light-emitting element EL. The gate electrode of the third transistor ST3 may be connected to the emission control line EML(n), the source electrode thereof may be connected to the second node N2, and the drain electrode thereof may be connected to the third node N3. The source electrode of the third transistor ST3 may be connected to the drain electrode of the driving transistor DT and the drain electrode of the sixth transistor ST6 through the second node N2. The drain electrode of the third transistor ST3 may be connected to the anode electrode of the light-emitting element EL and the source electrode of the fourth transistor ST4 through the third node N3.

When all of the second transistor ST2, the driving transistor DT and the third transistor ST3 are turned on, the driving current can be supplied to the light-emitting element EL.

The fourth transistor ST4 may be turned on by the emission signal of the emission control line EML(n) to connect the first initialization voltage line VIL1 with the third node N3, i.e., the anode electrode of the light-emitting element EL. The fourth transistor ST4 may be turned on based on the emission signal, thereby discharging the anode electrode of the light-emitting element EL to the first initialization voltage. The gate electrode of the fourth transistor ST4 may be connected to the emission control line EML(n), the drain electrode thereof may be connected to the first initialization voltage line VIL1, and the source electrode thereof may be connected to the third node N3. The drain electrode of the fourth transistor ST4 may be connected to the anode electrode of the light-emitting element EL and the drain electrode of the third transistor ST3 through the third node N3.

The fifth transistor ST5 may be turned on by a first scan signal Ga(n) of the first scan line GLa(n) and may connect the second initialization voltage line VIL2 with a fourth node N4, i.e., the gate electrode of the driving transistor DT. The fifth transistor ST5 may be turned on based on the first scan signal Ga(n), thereby discharging the gate electrode of the driving transistor DT to the second initialization voltage. The gate electrode of the fifth transistor ST5 may be connected to the first scan line GLa(n), the drain electrode thereof may be connected to the second initialization voltage line VIL2, and the source electrode thereof may be connected to the fourth node N4. The source electrode of the fifth transistor ST5 may be connected to the gate electrode of the driving transistor DT, the source electrode of the sixth transistor ST6, and the first electrode of the second capacitor C2 through the fourth node N4.

The sixth transistor ST6 may be turned on by the second scan signal Gb(n) of the second scan line GLb(n) to connect the second node N2, i.e., the drain electrode of the driving transistor DT with the fourth node N4, i.e., the gate electrode of the driving transistor DT. The gate electrode of the sixth transistor ST6 may be connected to the second scan line GLb(n), the drain electrode thereof may be connected to the second node N2, and the source electrode thereof may be connected to the fourth node N4. The drain electrode of the sixth transistor ST6 may be connected to the drain electrode of the driving transistor DT and the source electrode of the third transistor ST3 through the second node N2. The source electrode of the sixth transistor ST6 may be electrically connected to the gate electrode of the driving transistor DT, the source electrode of the fifth transistor ST5, and the first electrode of the second capacitor C2 through the fourth node N4.

Each of the driving transistor DT, the first transistor ST1, the second transistor ST2, and the third transistor ST3 may include a silicon-based active layer. For example, each of the driving transistor DT, the first transistor ST1, the second transistor ST2, and the third transistor ST3 may include an active layer including (or made of) low-temperature polycrystalline silicon (LTPS). The active layer made of low-temperature polycrystalline silicon may have a high electron mobility and excellent turn-on characteristics. Therefore, the display device 10 includes the driving transistor DT, the first transistor ST1, the second transistor ST2, and the third transistor ST3 having excellent turn-on characteristics so that a plurality of sub-pixels can be driven stably and efficiently.

Each of the driving transistor DT, the first transistor ST1, the second transistor ST2, and the third transistor ST3 may be a p-type transistor. For example, each of the driving transistor DT, the first transistor ST1, the second transistor ST2, and the third transistor ST3 may output a current flowing into the source electrode to the drain electrode based on a gate-low voltage applied to the gate electrode.

Each of the fourth transistor ST4, the fifth transistor ST5, and the sixth transistor ST6 may include an oxide-based active layer. For example, each of the fourth transistor ST4, the fifth transistor ST5, and the sixth transistor ST6 may have a coplanar structure in which a gate electrode is disposed above an oxide-based active layer. A transistor having such a coplanar structure has excellent leakage current characteristics and allows for low-frequency driving, thereby reducing power consumption. Accordingly, the display device 10 includes the fourth transistor ST4, the fifth transistor ST5, and the sixth transistor ST6 having excellent leakage current characteristics so that it is possible to prevent leakage current from flowing inside the sub-pixels and to maintain the voltage inside the sub-pixel stable.

Each of the fourth transistor ST4, the fifth transistor ST5, and the sixth transistor ST6 may be an n-type transistor. For example, each of the fourth transistor ST4, the fifth transistor ST5, and the sixth transistor ST6 may output a current flowing into the source electrode to the drain electrode based on a gate-high voltage applied to the gate electrode.

The first capacitor C1 may be connected between the emission control line EML(n) and the first node N1. For example, a first electrode of the first capacitor C1 may be connected to the emission control line EML(n), and a second electrode of the first capacitor C1 may be connected to the first node N1, i.e., the source electrode of the driving transistor DT. The first capacitor C1 stores the difference in voltage between the emission control line EML(n) and the source electrode of the driving transistor DT so that the source electrode of the driving transistor DT can control the voltage.

The first capacitor C1 may couple a source electrode DT_S of the driving transistor DT using a gate-off voltage of the emission signal. For example, when the emission signal EM(n) provided from the emission control line EML(n) rises, the first capacitor C1 may increase the voltage at the first node N1, and when the emission signal EM(n) falls, it may decrease the voltage at the first node N1. Accordingly, the first capacitor C1 can control the voltage at the source electrode of the driving transistor DT in synchronization with the rising or falling edge of the emission signal EM(n).

The second capacitor C2 may be connected between the fourth node N4, i.e., the gate electrode of the driving transistor DT, and the driving voltage line VDDL. For example, the first electrode of the second capacitor C2 is connected to the fourth node N4, and the second electrode of the second capacitor C2 is connected to the driving voltage line VDDL, such that the potential difference between the driving voltage VDDL and the gate electrode of the driving transistor DT is held (or stored) by the second capacitor C2.

In FIG. 6, the plurality of sub-pixels may be driven according to a driving frequency (e.g., a predetermined driving frequency). The plurality of sub-pixels may display an image that changes (e.g., refreshes) relatively fast in a high-speed driving mode and may display an image that changes (e.g., refreshes) relatively slowly in a low-speed driving mode. Herein, it is to be understood that the high-speed driving mode and the low-speed driving mode are relative expressions, and the driving frequency of each of the high-speed driving mode and the low-speed driving mode is not limited to a specific value.

The display device 10 may change the driving frequency when the display device 10 is turned on or driven. For example, the display device 10 may supply a plurality of scan signals to the plurality of sub-pixels based on a 240 Hz driving frequency. In such case, the scan driver 410 may supply first to third scan signals Ga(n), Gb(n), and Gc(n) having the driving frequency of 240 Hz to the plurality of pixels through first to third scan signals Ga(n), Gb(n), and Gc(n), respectively, and the emission control driver 420 may apply the emission signal EM(n) having the driving frequency of 240 Hz to the plurality of pixels through the emission control line EML(n).

For example, the display device 10 may change the 240 Hz driving frequency to a 120 Hz driving frequency. In such case, the emission control driver 420 may supply the emission signal EM(n) having the driving frequency of 240 Hz to the plurality of pixels through the emission control line EML(n), and the scan driver 410 may supply the first to third scan signals Ga(n), Gb(n), and Gc(n) having the driving frequency of 120 Hz to the plurality of pixels through the first to third scan lines GLa(n), GLb(n), and GLc(n).

When the display device 10 changes from the 240 Hz driving frequency to the 120 Hz driving frequency, the emission signal EM(n) may still have the gate-on voltage and the gate-off voltage according to the 240 Hz driving frequency. For example, the emission signal EM(n) may have the gate-on voltage and the gate-off voltage in each of the first frame period Frame1 and the second frame period Frame2.

In addition, when the display device 10 changes from the 240 Hz driving frequency to the 120 Hz driving frequency, each of the first to third scan signals Ga(n), Gb(n), and Gc(n) may have the gate-on voltage and the gate-off voltage according to the driving frequency of 120 Hz. For example, each of the first to third scan signals Ga(n), Gb(n), and Gc(n) may have the gate-on voltage and the gate-off voltage in the first frame period Frame1 but may hold the gate-off voltage in the second frame period Frame2.

As another example, the display device 10 may change from the 240 Hz driving frequency to the 80 Hz driving frequency of. In such case, the emission control driver 420 may supply the emission signal EM(n) having the driving frequency of 240 Hz to the plurality of pixels through the emission control line EML(n), and the scan driver 410 may supply the first to third scan signals Ga(n), Gb(n), and Gc(n) having the driving frequency of 80 Hz to the plurality of pixels through the first to third scan lines GLa(n), GLb(n), and GLc(n).

Accordingly, it is possible to reduce the power consumption of the display device 10 by maintaining some of the plurality of signals supplied to the plurality of pixels that require high-speed driving at a high-speed driving while changing some other signals to a low-speed driving.

Referring to FIG. 6 in conjunction with FIG. 5, when the display device 10 is driven at the 120 Hz driving frequency, the emission signal EM(n) may have the gate-on voltage and the gate-off voltage in each of the first frame period Frame1 and the second frame period Frame2, and each of the first to third scan signals Ga(n), Gb(n), and Gc(n) may have the gate-on voltage and the gate-off voltage in the first frame period Frame1 and may maintain the gate-off voltage in the second frame period Frame2. Therefore, when the display device 10 changes from the 240 Hz driving frequency to the 120 Hz driving frequency, the emission signal EM(n) may still be driven at the driving frequency of 240 Hz, and the first to third scan signals Ga(n), Gb(n), and Gc(n) may be driven at the driving frequency of 120 Hz.

When the display device 10 is driven at the 120 Hz driving frequency, the first frame period Frame1 may include first to fourth periods t1 to t4.

The fourth transistor ST4 may receive the emission signal EM(n) at the high level during the first period t1. The fourth transistor ST4 may be turned on based on the emission signal EM(n) at the high level and may apply a first initialization voltage (hereinafter, referred to as "VI1") to a third node N3, i.e., the anode electrode of the light-emitting element EL. Therefore, the fourth transistor ST4 may initialize the anode electrode of the light-emitting element EL during the first period t1.

The fifth transistor ST5 may receive the first scan signal Ga(n) at the high level during the second period t2. The fifth transistor ST5 may be turned on based on the first scan signal Ga(n) at the high level and may apply a second initialization voltage (hereinafter, referred to as "VI2") to a fourth node N4, i.e., the gate electrode of the driving transistor DT. Therefore, the fifth transistor ST5 may initialize the gate electrode of the driving transistor DT during the second period t2.

The sixth transistor ST6 may receive the second scan signal Gb(n) at the high level during the third period t3. The sixth transistor ST6 may be turned on based on the second scan signal Gb(n) at the high level and may connect the second node N2 with the fourth node N4.

The first transistor ST1 may receive the third scan signal Gc(n) at the low level during the fourth period t4. The first transistor ST1 may be turned on based on the third scan signal Gc(n) at the low level and may apply a data voltage (hereinafter, referred to as "Vdata") to the first node N1, i.e., the gate electrode of the driving transistor DT.

When the source electrode of the driving transistor DT receives the data voltage Vdata, the source-gate voltage Vsg of the driving transistor DT may be equal (or substantially equal) to the difference in voltage between the data voltage Vdata and the second initialization voltage VI2 (Vdata−VI2), and the source-gate voltage Vsg becomes greater than the threshold voltage (hereinafter referred to as "Vth") (Vdata−VI2>=Vth), and thus, the driving transistor DT may be turned on. Therefore, at the moment when the driving transistor DT is turned on in the fourth period T4, the source-drain current Isd of the driving transistor DT may be determined based on the data voltage Vdata, the second initialization voltage VI2, and the threshold voltage Vth of the driving transistor DT (Isd=k*(Vdata−VI2−Vth)^2). The driving transistor DT may supply the source-drain current Isd to the second node N2 until the source-gate voltage Vsg reaches the threshold voltage Vth of the driving transistor DT. The sixth transistor ST6 may be turned on during the third period t3 to supply the voltage at the second node N2 to the fourth node N4. In this manner, while the driving transistor DT is turned on, the voltage at the fourth node N4 and the source-drain current Isd of the driving transistor DT may be changed, and the voltage at the fourth node N4 may eventually converge to the difference in voltage Vdata−Vth between the data voltage Vdata and the threshold voltage Vth of the driving transistor DT.

When the emission signal EM(n) transitions from the low level to the high level, the first capacitor C1 may couple the source electrode of the driving transistor DT. For example, the first capacitor C1 may increase the voltage at the first node N1 when the emission signal EM(n) provided from the emission control line EML(n) rises. Accordingly, the first capacitor C1 controls the voltage at the source electrode of the driving transistor DT in synchronization with the rising edge of the emission signal EM(n). Therefore, even when the driving frequency is changed, the display device 10 can prevent (or substantially prevent) flicker and/or ghost images by controlling the voltage at the source electrode of the driving transistor DT.

The emission signal EM(n) may have the gate-on voltage and the gate-low voltage during the second frame period Frame2. When the emission signal EM(n) has the high level, the fourth transistor ST4 may be turned on to initialize the anode electrode of the light-emitting element EL and the second and third transistors ST2 and ST3 may be turned off. When the emission signal EM(n) has the low level, the fourth transistor ST4 may be turned off while the second and third transistors ST2 and ST3 may be turned on to supply the driving current to the light-emitting element EL.

Each of the first to third scan signals Ga(n), Gb(n), and Gc(n) may hold the gate-off voltage during the second frame period Frame2. The first and second scan signals Ga(n) and Gb(n) may have the low level, and the third scan signal Gc(n) may have the high level. Accordingly, the first, fifth and sixth transistors ST1, ST5, and ST6 may be turned off.

Figure 7:
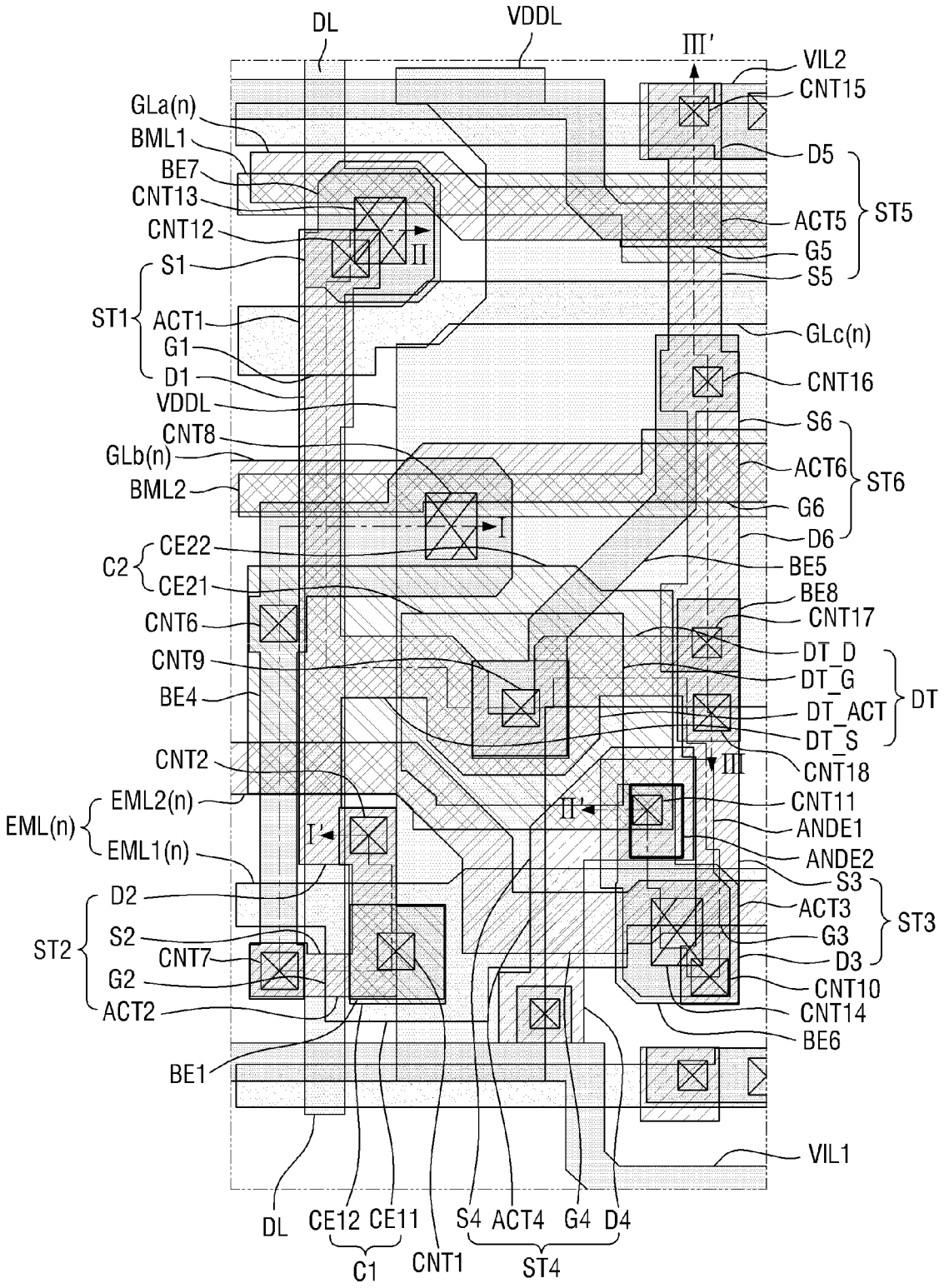
FIG. 7 is a plan view showing an example of the sub-pixel shown in FIG. 5.
Figure 8:
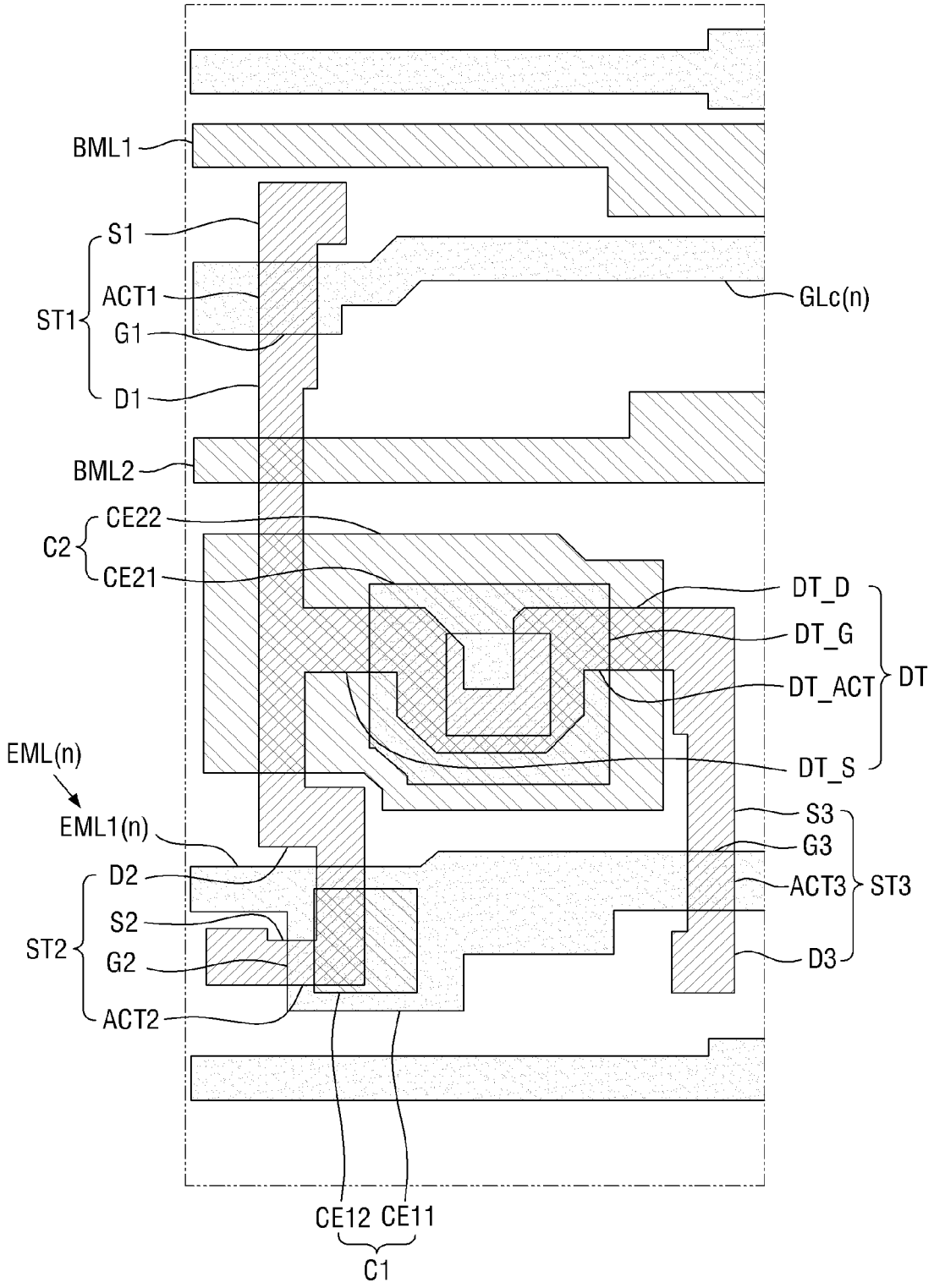
FIG. 8 is a plan view showing some of the layers of the sub-pixel shown in FIG. 7.
Figure 9:
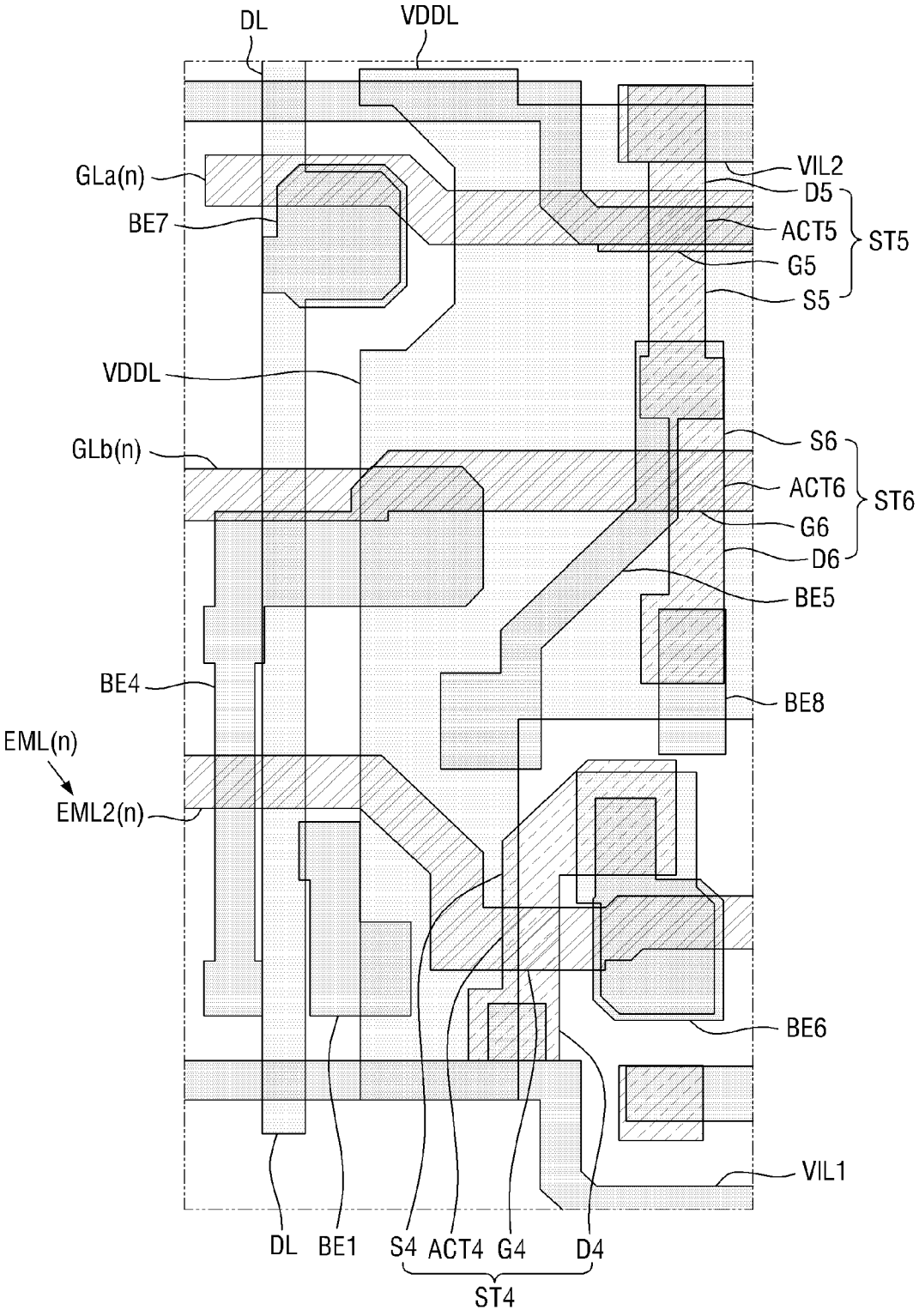
FIG. 9 is a plan view showing some others of the layers of the sub-pixel shown in FIG. 7.

FIG. 7 is a plan view showing an example of the sub-pixel shown in FIG. 5, FIG. 8 is a plan view showing some of the layers of the sub-pixel shown in FIG. 7, and FIG. 9 is a plan view showing some others of the layers of the sub-pixel shown in FIG. 7. FIG. 7 shows a stack of a first active layer, a first gate layer, a second gate layer, a second active layer, a third gate layer, a first source-drain layer, and a second source-drain layer in this order according to an embodiment of the present disclosure, FIG. 8 shows a stack of the first active layer, the first gate layer, and the second gate layer in this order, and FIG. 9 shows a stack of the second active layer, the third gate layer, the first source-drain layer, and the second source-drain layer in this order. The stacking relationship of the layers shown in FIGS. 7 to 9 will be described in detail with reference to FIGS. 10 to 12.

The driving transistor DT may include an active layer DT_ACT, a gate electrode DT_G, a source electrode DT_S, and a drain electrode DT_D. The active layer DT_ACT of the driving transistor DT may overlap the gate electrode DT_G of the driving transistor DT. For example, the active layer DT_ACT of the driving transistor DT may be made of low-temperature polycrystalline silicon (LTPS).

The gate electrode DT_G of the driving transistor DT may be connected to the fifth connection electrode BE5 through a ninth contact opening (e.g., a ninth contact hole) CNT9, and the fifth connection electrode BE5 may be connected to the source electrode S5 of the fifth transistor ST5 and the source electrode S6 of the sixth transistor ST6 through a sixteenth contact opening (e.g., a sixteenth contact hole) CNT16. A part of the first gate electrode DT_G of the driving transistor DT that overlaps the second electrode CE22 of the second capacitor C2 may be the first electrode CE21 of the second capacitor C2.

The source electrode DT_S of the driving transistor DT may be connected to the drain electrode D1 of the first transistor ST1 and the drain electrode D2 of the second transistor ST2. The source electrode DT_S of the driving transistor DT may be connected to a first connection electrode BE1 through a second contact opening (e.g., a second contact hole) CNT2, and the first connection electrode BE1 may be connected to a second electrode CE12 of the first capacitor C1 through a first contact opening (e.g., a first contact hole) CNT1.

The drain electrode DT_D of the driving transistor DT may be connected to a source electrode S3 of the third transistor ST3. The drain electrode DT_D of the driving transistor DT may be connected to an eighth connection electrode BE8 through an eighteenth connection electrode CNT18, and the eighth connection electrode BE8 may be connected to a drain electrode D6 of the sixth transistor ST6 through a seventeenth contact opening (e.g., a seventeenth contact hole) CNT17.

The first transistor ST1 may include an active layer ACT1, a gate electrode G1, a source electrode S1, and a drain electrode D1. The active layer ACT1 of the first transistor ST1 may overlap the gate electrode G1 of the first transistor ST1. For example, the active layer ACT1 of the first transistor ST1 may be made of low-temperature polycrystalline silicon (LTPS). The gate electrode G1 of the first transistor ST1 may be a part of the third scan line GLc(n) that overlaps the active layer ACT1.

The source electrode S1 of the first transistor ST1 may be connected to a seventh connection electrode BE7 through a twelfth contact opening (e.g., a twelfth contact hole) CNT12, and the seventh connection electrode BE7 may be connected to the data line DL through a thirteenth contact opening (e.g., a thirteenth contact hole) CNT13.

The drain electrode D1 of the first transistor ST1 may be connected to the source electrode DT_S of the driving transistor DT and the drain electrode D2 of the second transistor ST2. The drain electrode D1 of the first transistor ST1 may be connected to the first connection electrode BE1 through the second contact opening CNT2, and the first connection electrode BE1 may be connected to a second electrode CE12 of the first capacitor C1 through the first contact opening CNT1.

The second transistor ST2 may include an active layer ACT2, a gate electrode G2, a source electrode S2, and a drain electrode D2. The active layer ACT2 of the second transistor ST2 may overlap the gate electrode G2 of the second transistor ST2. For example, the active layer ACT2 of the second transistor ST2 may be made of low-temperature polycrystalline silicon (LTPS). The gate electrode G2 of the second transistor ST2 may be a part of a first emission control line EML1(*n*) that overlaps the active layer ACT2.

The source electrode S2 of the second transistor ST2 may be connected to a fourth connection electrode BE4 through a seventh contact opening (e.g., a seventh contact hole) CNT7, and the fourth connection electrode BE4 may be connected to the driving voltage VDDL through an eighth contact opening (e.g., an eighth contact hole) CNT8. In addition, the fourth connection electrode BE4 may be connected to the second electrode CE22 of the second capacitor C2 through a sixth contact opening (e.g., a sixth contact hole) CNT6.

The drain electrode D2 of the second transistor ST2 may be connected to the source electrode DT_S of the driving transistor DT and the drain electrode D1 of the first transistor ST1. The drain electrode D2 of the second transistor ST2 may be connected to the first connection electrode BE1 through the second contact opening CNT2, and the first connection electrode BE1 may be connected to a second electrode CE12 of the first capacitor C1 through the first contact opening CNT1.

The third transistor ST3 may include an active layer ACT3, a gate electrode G3, a source electrode S3, and a drain electrode D3. The active layer ACT3 of the third transistor ST3 may overlap the gate electrode G3 of the third transistor ST3. For example, the active layer ACT3 of the third transistor ST3 may be made of low-temperature polycrystalline silicon (LTPS). The gate electrode G3 of the third transistor ST3 may be a part of the first emission control line EML1(*n*) that overlaps the active layer ACT3.

The source electrode S3 of the third transistor ST3 may be connected to the drain electrode DT_D of the driving transistor DT. The source electrode S3 of the third transistor ST3 may be connected to the eighth connection electrode BE8 through the eighteenth connection electrode CNT18, and the eighth connection electrode BE8 may be connected to the drain electrode D6 of the sixth transistor ST6 through the seventeenth contact opening CNT17.

The drain electrode D3 of the third transistor ST3 may be connected to a sixth connection electrode BE6 through a tenth contact opening (e.g., a tenth contact hole) CNT10. The sixth connection electrode BE6 may be connected to a first anode connection electrode ANDE1 through a fourteenth contact opening (e.g., a fourteenth contact hole) CNT14, and the first anode connection electrode ANDE1 may be connected to the anode electrode of the light-emitting element EL through a second anode connection electrode ANDE2. The sixth connection electrode BE6 may be connected to the source electrode S4 of the fourth transistor ST4 through an eleventh contact opening (e.g., an eleventh contact hole) CNT11.

The fourth transistor ST4 may include an active layer ACT4, a gate electrode G4, a drain electrode D4, and a source electrode S4. The active layer ACT4 of the fourth transistor ST4 may overlap the gate electrode G4 of the fourth transistor ST4. For example, the active layer ACT4 of the fourth transistor ST4 may include an oxide-based active layer. The gate electrode G4 of the fourth transistor ST4 may be a part of a second emission control line EML2(*n*) that overlaps the active layer ACT4.

The drain electrode D4 of the fourth transistor ST4 may be connected to the first initialization voltage line VIL1 to receive the first initialization voltage VI1.

The source electrode S4 of the fourth transistor ST4 may be connected to the sixth connection electrode BE6 through the eleventh contact opening CNT11. The sixth connection electrode BE6 may be connected to the drain electrode D3 of the third transistor ST3 through the tenth contact opening CNT10 and the first anode connection electrode ANDE1 through the fourteenth contact opening CNT14.

The fifth transistor ST5 may include an active layer ACT5, a gate electrode G5, a drain electrode D5, and a source electrode S5. The active layer ACT5 of the fifth transistor ST5 may overlap the gate electrode G5 of the fifth transistor ST5. For example, the active layer ACT5 of the fifth transistor ST5 may include an oxide-based active layer. The gate electrode G5 of the fifth transistor ST5 may be a part of the first scan line GLa(n) that overlaps the active layer ACT5.

The drain electrode D5 of the fifth transistor ST5 may be connected to the second initialization voltage line VIL2 through a fifteenth contact opening (e.g., a fifteenth contact hole) CNT15 to receive the second initialization voltage VI2.

The source electrode S5 of the fifth transistor ST5 may be connected to the source electrode S6 of the sixth transistor ST6. The source electrode S5 of the fifth transistor ST5 may be connected to the fifth connection electrode BE5 through the sixteenth contact opening CNT16, and the fifth connection electrode BE5 may be connected to the gate electrode DT_G of the driving transistor DT through the ninth contact opening CNT9. A part of the first gate electrode DT_G of the driving transistor DT that overlaps the second electrode CE22 of the second capacitor C2 may be the first electrode CE21 of the second capacitor C2.

The sixth transistor ST6 may include an active layer ACT6, a gate electrode G6, a drain electrode D6, and a source electrode S6. The active layer ACT6 of the sixth transistor ST6 may overlap the gate electrode G6 of the sixth transistor ST6. For example, the active layer ACT6 of the sixth transistor ST6 may include an oxide-based active layer. The gate electrode G6 of the sixth transistor ST6 may be a part of the second scan line GLb(n) that overlaps the active layer ACT6.

The drain electrode D6 of the sixth transistor ST6 may be connected to the eighth connection electrode BE8 through the seventeenth contact opening CNT17. The eighth connection electrode BE8 may be connected to the drain electrode DT_D of the driving transistor DT and the source electrode S3 of the third transistor ST3.

The source electrode S6 of the sixth transistor ST6 may be connected to the source electrode S5 of the fifth transistor ST5. The source electrode S6 of the sixth transistor ST6 may be connected to the fifth connection electrode BE5 through the sixteenth contact opening CNT16, and the fifth connection electrode BE5 may be connected to the gate electrode DT_G of the driving transistor DT through the ninth contact opening CNT9. A part of the first gate electrode DT_G of the driving transistor DT that overlaps the second electrode CE22 of the second capacitor C2 may be the first electrode CE21 of the second capacitor C2.

The first capacitor C1 may include a first electrode CE11 and a second electrode CE12. The first electrode CE11 of the first capacitor C1 may be a part of the first emission control line EML1(*n*) that overlaps the second electrode CE12 of the first capacitor C1. The second electrode CE12 of the first capacitor C1 may be connected to the first connection electrode BE1 through the first contact opening CNT1. The first connection electrode BE1 may be connected to the source electrode DT_S of the driving transistor DT through the second contact opening CNT2. Accordingly, the first capacitor C1 stores the difference in voltage between the emission control line EML(n) and the source electrode DT_S of the driving transistor DT, and thus, it is possible to control the voltage at the source electrode DT_S of the driving transistor DT to thereby prevent (or substantially reduce) flicker and/or ghost images.

The second capacitor C2 may include a first electrode CE21 and a second electrode CE22. The first electrode CE21 of the second capacitor C2 may be a part of the gate electrode DT_G of the driving transistor DT that overlaps the second electrode CE22 of the second capacitor C2. The second electrode CE22 of the second capacitor C2 may be connected to the fourth connection electrode BE4 through the sixth contact opening CNT6, and the fourth connection electrode BE4 may be connected to the driving voltage line VDDL through the eighth contact opening CNT8.

Figure 10:
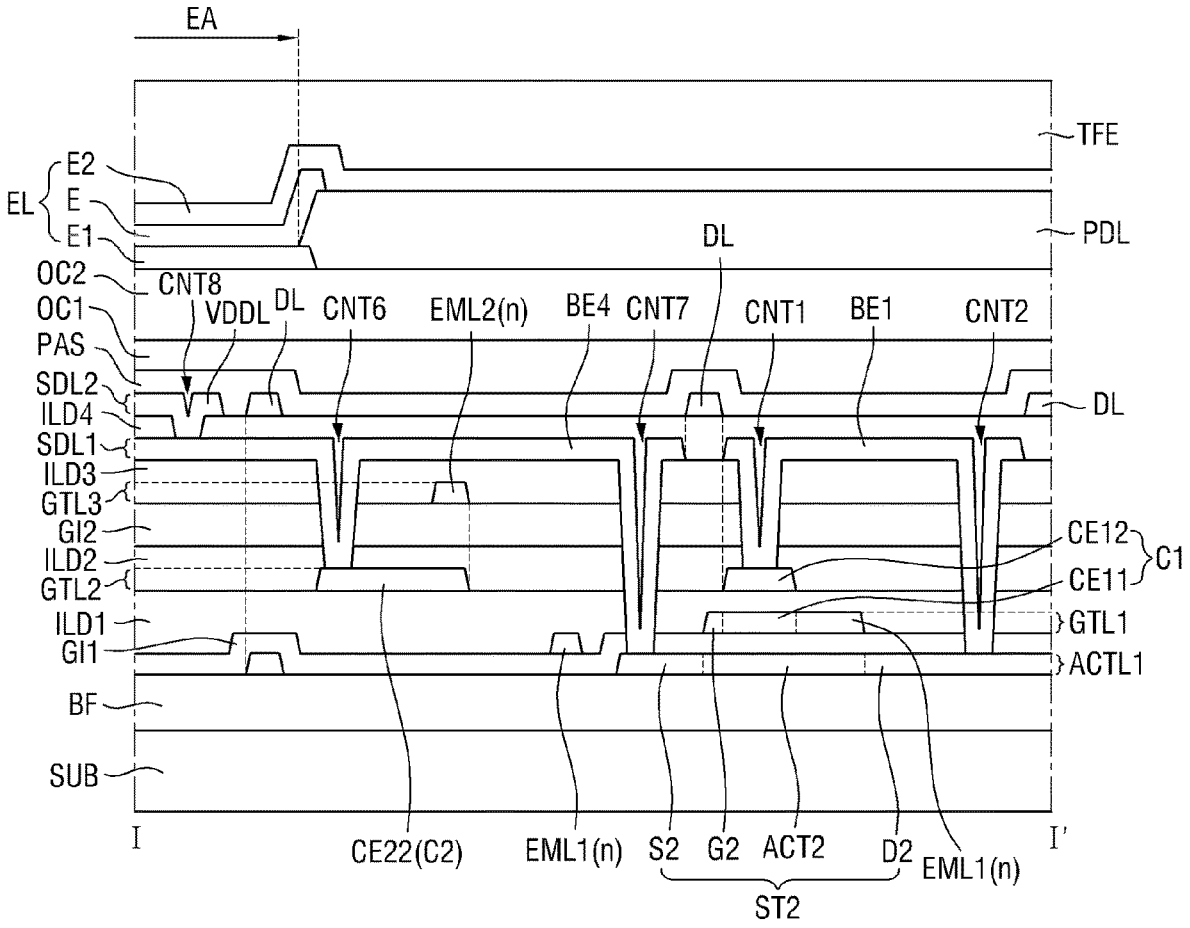
FIG. 10 is a cross-sectional view, taken along the line I-I' of FIG. 7.
Figure 11:
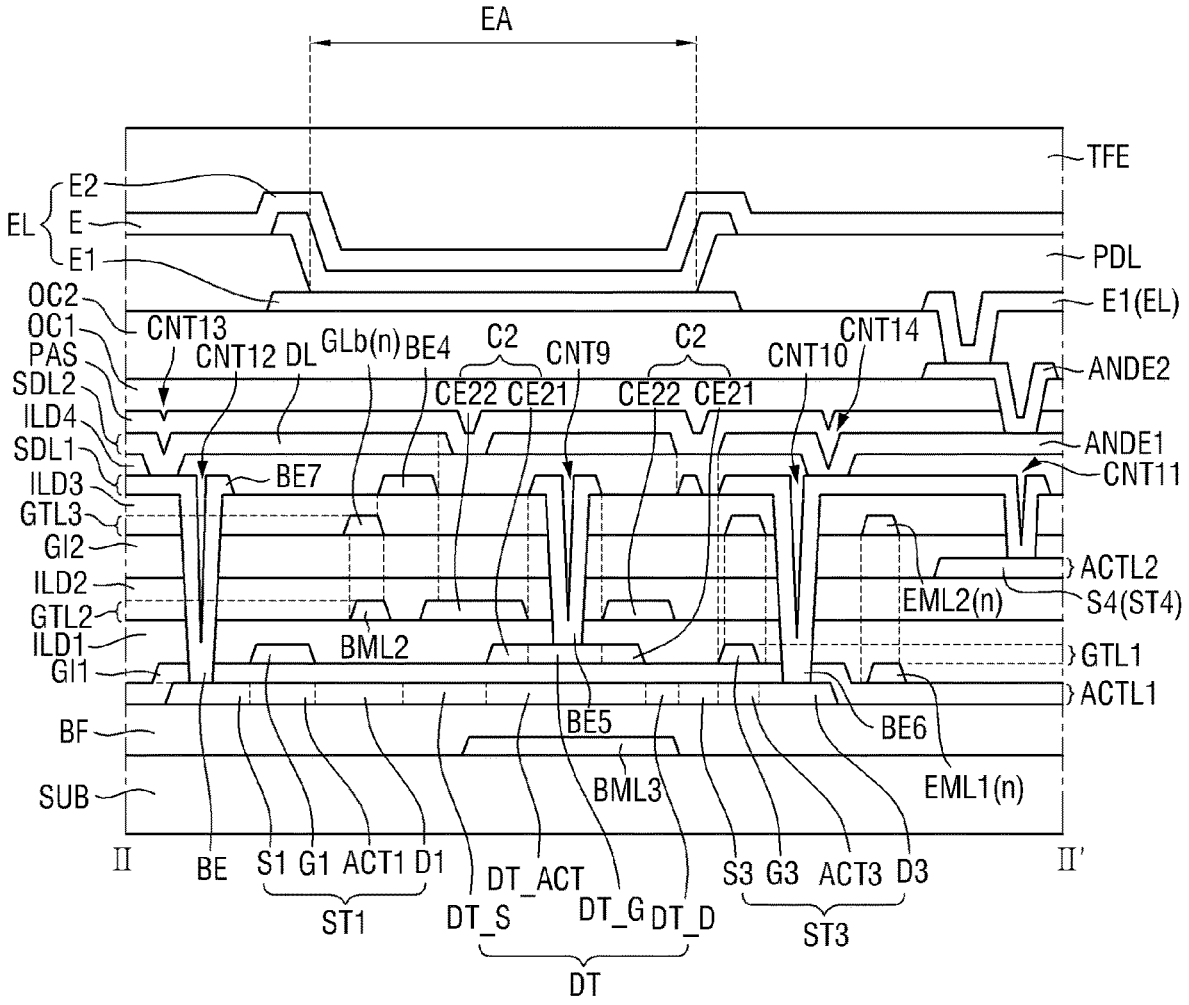
FIG. 11 is a cross-sectional view taken along the line II-II' of FIG. 7.
Figure 12:
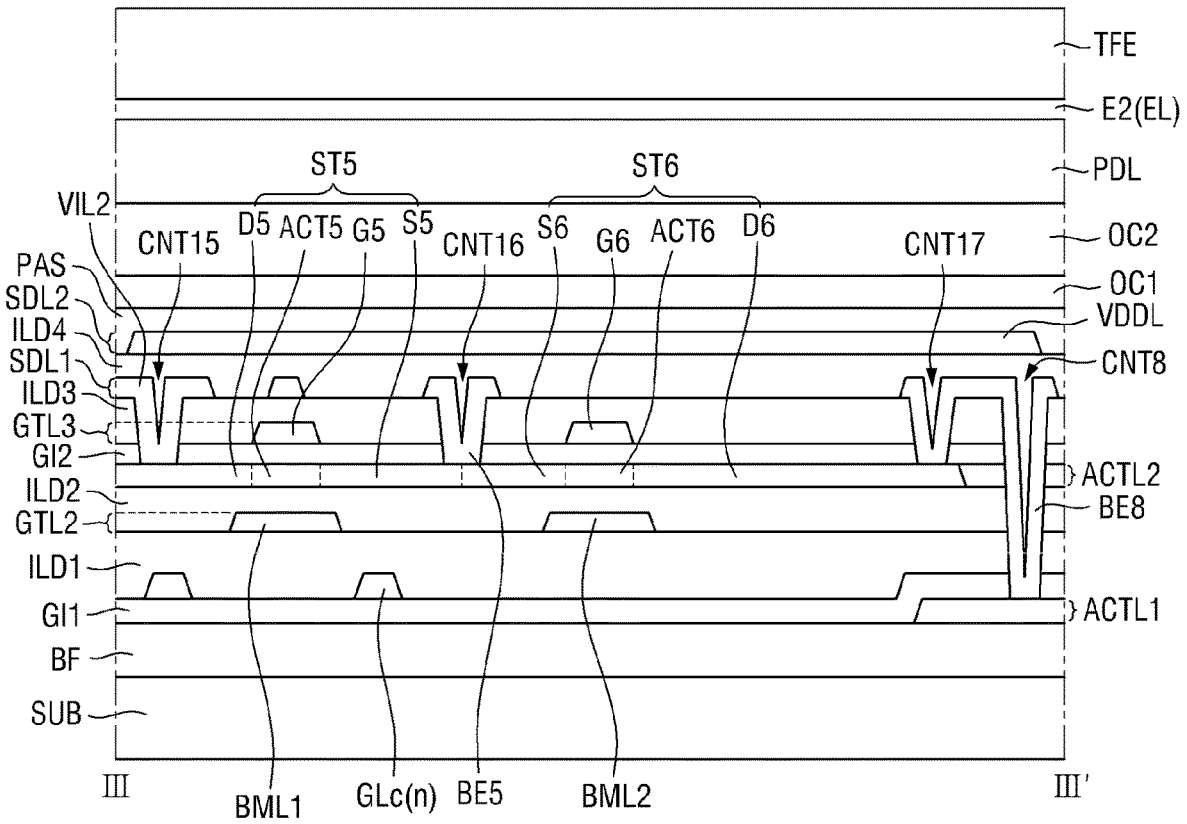
FIG. 12 is a cross-sectional view, taken along the line III-III' of FIG. 7.

FIG. 10 is a cross-sectional view, taken along the line I-I' of FIG. 7, FIG. 11 is a cross-sectional view, taken along the line II-II' of FIG. 7, and FIG. 12 is a cross-sectional view, taken along the line III-III' of FIG. 7.

Referring to FIGS. 10 to 12, the display panel 300 may include a substrate SUB, a buffer layer BF, a first active layer ACTL1, a first gate insulating layer GI1, a first gate layer GTL1, a first interlayer dielectric layer ILD1, a second gate layer GTL2, a second interlayer dielectric layer ILD2, a second active layer ACT2, a second gate insulating layer GI2, a third gate layer GTL3, a third interlayer dielectric layer ILD3, a first source-drain layer SDL1, a fourth interlayer dielectric layer ILD4, a second source-drain layer SDL2, a passivation layer PAS, a first planarization layer OC1, a second planarization layer OC2, a light-emitting element EL, a pixel-defining layer PDL, and an encapsulation layer TFE.

The substrate SUB may be a base substrate and may include (or may be made of) an insulating material, such as a polymer resin. For example, the substrate SUB may be a flexible substrate that can be bent, folded, or rolled.

A third light-blocking layer BML3 may be disposed on the substrate SUB and may overlap the driving transistor DT. The third light-blocking layer BML3 can block light incident on the driving transistor DT and the light-emitting element EL.

The buffer layer BF may be disposed on the substrate SUB to cover the third light-blocking layer BML3. For example, the buffer layer BF may include a plurality of inorganic layers and may be formed on the entire upper surface of the substrate SUB in order to block moisture permeating into the light-emitting element EL through the substrate SUB.

The first active layer ACTL1 may be disposed on the buffer layer BF. The first active layer ACTL1 may include (or may be made of) a silicon-based material. For example, the first active layer ACTL1 may be made of low-temperature polycrystalline silicon (LTPS). The active layers DT_ACT, ACT1, ACT2 and ACT3, the source electrodes DT_S, S1, S2, and S3 and the drain electrodes DT_D, D1, D2 and D3 of the driving transistor DT, the first transistor ST1, the second transistor ST2, and the third transistor ST3, respectively, may be disposed in the first active layer ACTL1.

The first gate insulating layer GI1 may cover the buffer layer BF and the first active layer ACTL1 and may insulate the first active layer ACTL1 from the first gate layer GTL1.

The first gate layer GTL1 may be disposed on the first gate insulating layer GI1. The gate electrode DT_G of the driving transistor DT, the first emission control line EML1 (*n*), and the third scan line GLc(n) may be disposed in the first gate layer GTL1.

A part of the first gate electrode DT_G may overlap the second electrode CE22 of the second capacitor C2 to form the first electrode CE21 of the second capacitor C2.

A part of the first emission control line EML1(*n*) may overlap the active layer ACT2 of the second transistor ST2 to form the gate electrode G2 of the second transistor ST2. Another part of the first emission control line EML1(*n*) may overlap the active layer ACT3 of the third transistor ST3 to form the gate electrode G3 of the third transistor ST3. Yet another part of the first emission control line EML1(*n*) may overlap the second electrode CE12 of the first capacitor C1 to form the first electrode CE11 of the first capacitor C1.

A part of the third scan line GLc(n) may overlap the active layer ACT1 of the first transistor ST1 to form the gate electrode G1 of the first transistor ST1.

The first interlayer dielectric layer ILD1 may cover the first gate layer GTL1 and the first gate insulating layer GI1. The first interlayer dielectric layer ILD1 may insulate the first gate layer GTL1 from the second gate layer GTL2.

The second gate layer GTL2 may be disposed on the first interlayer dielectric layer ILD1. The first light-blocking layer BML1, the second light-blocking layer BML2, the second electrode CE12 of the first capacitor C1, and the second electrode CE22 of the second capacitor C2 may be disposed on the second gate layer GTL2.

The first light-blocking layer BML1 may be disposed to overlap the fifth transistor ST5 to block light incident on the fifth transistor ST5. The second light-blocking layer BML2 may be disposed to overlap the sixth transistor ST6 to block light incident on the sixth transistor ST6.

The second electrode CE12 of the first capacitor C1 may be connected to the first connection electrode BE1 of the first source-drain layer SDL1 through the first contact opening CNT1, and the first connection electrode BE1 may be connected to the drain electrode D2 of the second transistor ST2 in the first active layer ACTL1 and the source electrode DT_S of the driving transistor DT through the second contact opening CNT2. Accordingly, the first capacitor C1 stores the difference in voltage between the emission control line EML(n) and the source electrode DT_S of the driving transistor DT, and thus, it is possible to control the voltage at the source electrode DT_S of the driving transistor DT to thereby prevent (or substantially prevent) flicker and/or ghost images.

The second electrode CE22 of the second capacitor C2 may be connected to the fourth connection electrode BE4 of the first source-drain layer SDL1 through the sixth contact opening CNT6, and the fourth connection electrode BE4 may be connected to the driving voltage line VDDL of the second source-drain layer SDL2 through the eighth contact opening CNT8. Accordingly, the second capacitor C2 may maintain a potential difference between the driving voltage line VDDL and the gate electrode DT_G of the driving transistor DT.

The second interlayer dielectric layer ILD2 may cover the second gate layer GTL2 and the first interlayer dielectric layer ILD1. The second interlayer dielectric layer ILD2 may insulate the second gate layer GTL2 from the second active layer ACTL2.

The second active layer ACTL2 may be disposed on the second interlayer dielectric layer ILD2. For example, the second active layer ACTL2 may be formed of an oxide-based material. The active layers ACT4, ACT5, and ACT6 and the drain electrodes D4, D5, and D6 and the source electrodes S4, S5, and S6 of the fourth to sixth transistors ST4, ST5, and ST6, respectively, may be disposed on the second active layer ACTL2.

The second gate insulating layer GI2 may cover the second interlayer dielectric layer ILD2 and the second active layer ACTL2 and may insulate the second active layer ACTL2 from the third gate layer GTL3.

The third gate layer GTL3 may be disposed on the second gate insulating layer GI2. The second emission control line EML2(*n*), the first scan line GLa(n), and the second scan line GLb(n) may be disposed in the third gate layer GTL3.

A part of the second emission control line EML1(*n*) may overlap the active layer ACT4 of the fourth transistor ST4 to form the gate electrode G4 of the fourth transistor ST4. A part of the first scan line GLa(n) may overlap the active layer ACT5 of the fifth transistor ST5 to form the gate electrode G5 of the fifth transistor ST5. A part of the second scan line GLb(n) may overlap the active layer ACT6 of the sixth transistor ST6 to form the gate electrode G6 of the sixth transistor ST6.

The third interlayer dielectric layer ILD3 may cover the third gate layer GTL3 and the second gate insulating layer GI2. The third interlayer dielectric layer ILD3 may insulate the third gate layer GTL3 from the first source-drain layer SDL1.

The first source-drain layer SDL1 may be disposed on the third interlayer dielectric layer ILD3. The first and fourth to eighth connection electrodes BE1, BE4, BE5, BE6, BE7, and BE8 may be disposed in the first source-drain layer SDL1.

The first connection electrode BD may be connected to the second electrode CE12 of the first capacitor C1 through the first contact opening CNT1 and may be connected to the drain electrode D2 of the second transistor ST2 and the source electrode DT_S of the driving transistor DT through the second contact opening CNT2.

The fourth connection electrode BE4 may be connected to the second electrode CE22 of the second capacitor C2 through the sixth contact opening CNT6, may be connected to the source electrode S2 of the second transistor ST2 through the seventh contact opening CNT7, and may be connected to the driving voltage line VDDL of the second source-drain layer SDL2 through the eighth contact opening CNT8.

The fifth connection electrode BE5 may be connected to the gate electrode DT_G of the driving transistor DT through the ninth contact opening CNT9 and may be connected to the source electrode S5 of the fifth transistor ST5 through the sixteenth contact opening CNT16.

The sixth connection electrode BE6 may be connected to the drain electrode D3 of the third transistor ST3 through the tenth contact opening CNT10, may be connected to the source electrode S4 of the fourth transistor ST4 through the eleventh contact opening CNT11, and may be connected to a first anode connection electrode ANDE1 through the fourteenth contact opening CNT14.

The seventh connection electrode BE7 may be connected to the source electrode S1 of the first transistor ST1 through the twelfth contact opening CNT12 and may be connected to the data line DL through the thirteenth contact opening CNT13.

The eighth connection electrode BE8 may be connected to the drain electrode D6 of the sixth transistor ST6 through the seventeenth connection electrode CNT17 and may be connected to the source electrode S3 of the third transistor ST3 through the eighteenth contact opening CNT18.

The fourth interlayer dielectric layer ILD4 may cover the first source-drain layer SDL1 and the third interlayer dielectric layer ILD3. The fourth interlayer dielectric layer ILD4 may insulate the first source-drain layer SDL1 from the second source-drain layer SDL2.

The second source-drain layer SDL2 may be disposed on the fourth interlayer dielectric layer ILD4. The data line DL, the driving voltage line VDDL, and the first anode connection electrode ANDE1 may be disposed in the second source-drain layer SDL2.

The passivation layer PAS may be disposed on the second source-drain layer SDL2 to protect the plurality of transistors of the sub-pixel SP.

The first planarization layer OC1 may be disposed on the passivation layer PAS to provide a flat surface over the sub-pixel SP.

The second anode connection electrode ANDE2 may be disposed in (or under) the first planarization layer OC1. The second anode connection electrode ANDE2 may connect the anode connection electrode ANDE1 with the anode electrode E1 of the light-emitting element EL.

The second planarization layer OC2 may cover the second anode connection electrode ANDE2 and the first planarization layer OC1.

The light-emitting element EL may be disposed on the second planarization layer OC2. The light-emitting element EL may include an anode electrode E1, an emission layer E, and a cathode electrode E2. The anode electrode E1 may be disposed on the second planarization layer OC2. For example, the anode electrode E1 may be disposed to overlap an opening area EA defined by (or defined in) the pixel-defining layer PDL.

The emission layer E may be disposed on the anode electrode E1. The emission layer E may include a hole injecting layer, a hole transporting layer, a light-emitting layer, an electron blocking layer, an electron transporting layer, an electron injecting layer, etc. For example, the emission layer E may be, but is not limited to, an organic emission layer including (or made of) an organic material.

The cathode electrode E2 may be disposed on the emission layer E. For example, the cathode electrode E2 may be implemented in the form of a common electrode that extends across all (e.g., covers) of the sub-pixels SP.

A thin-film encapsulation layer TFE may be disposed on the light-emitting element EL and the pixel-defining layer PDL to cover the plurality of sub-pixels SP. The thin-film encapsulation layer TFE can prevent (or substantially prevent) oxygen or moisture from permeating into the light-emitting element EL.

Figure 13:
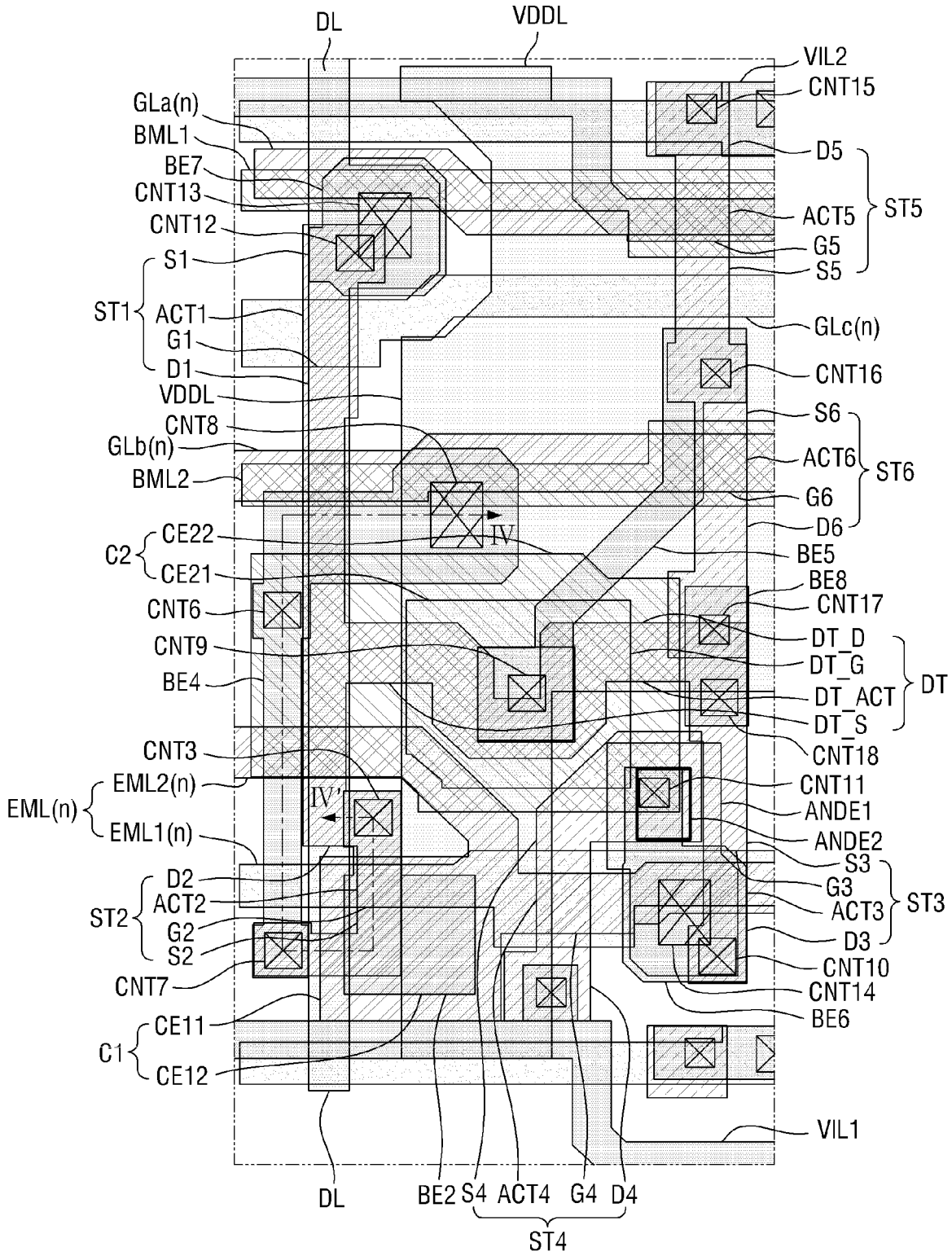
FIG. 13 is a plan view showing another example of the sub-pixel shown in FIG. 5.
Figure 14:
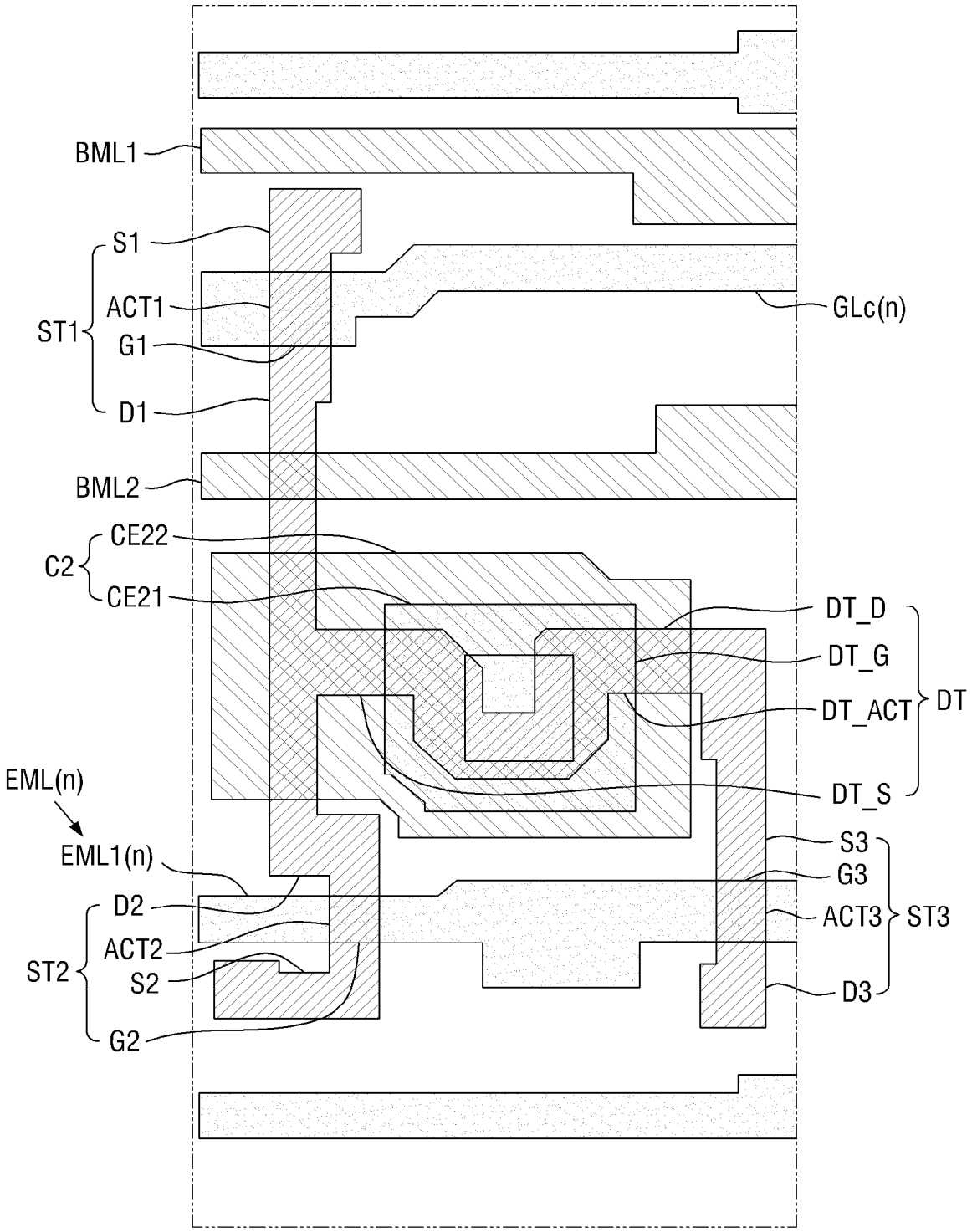
FIG. 14 is a plan view showing some layers of the sub-pixel shown in FIG. 13.
Figure 15:
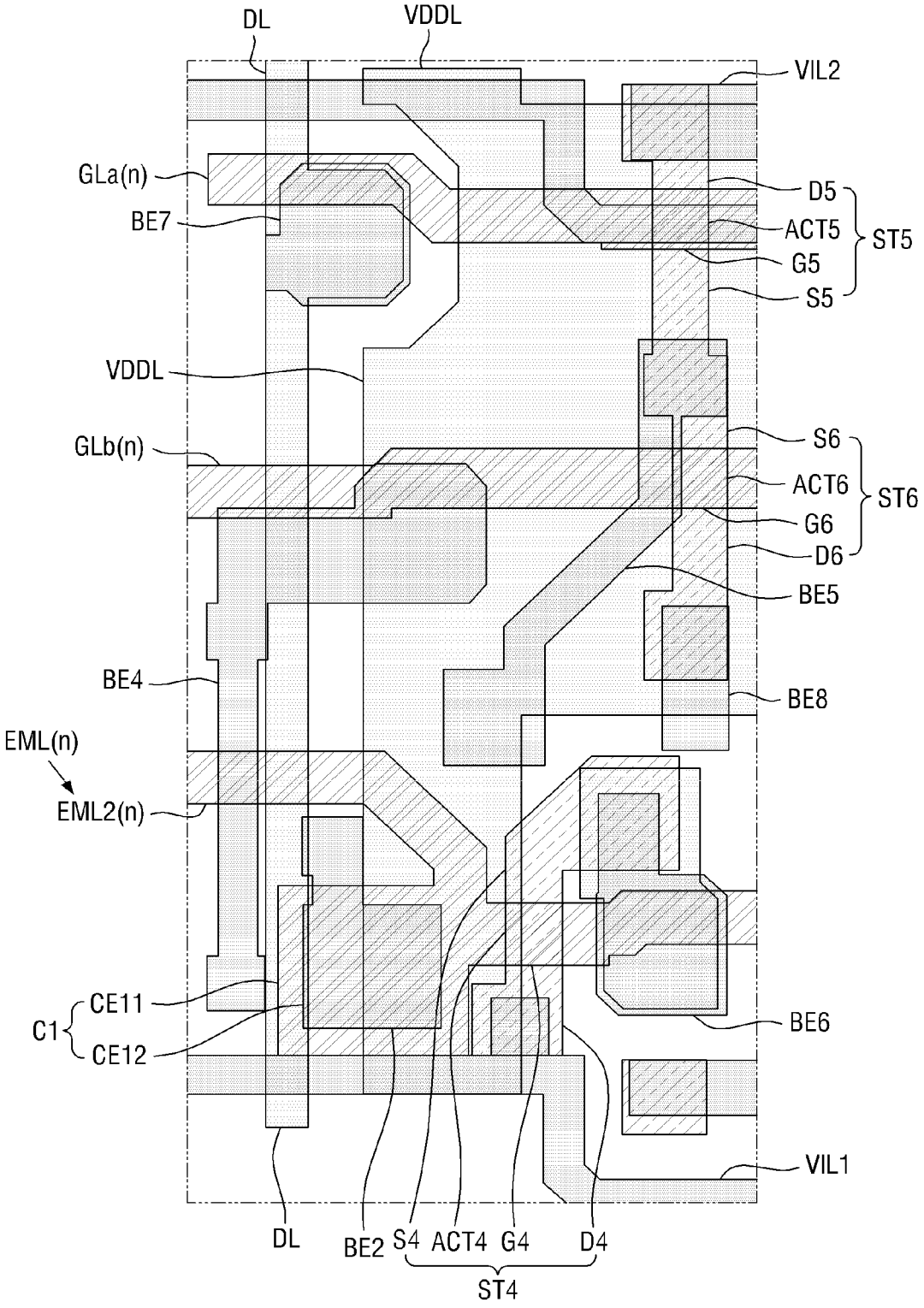
FIG. 15 is a plan view showing some others of the layers of the sub-pixel shown in FIG. 13.
Figure 16:
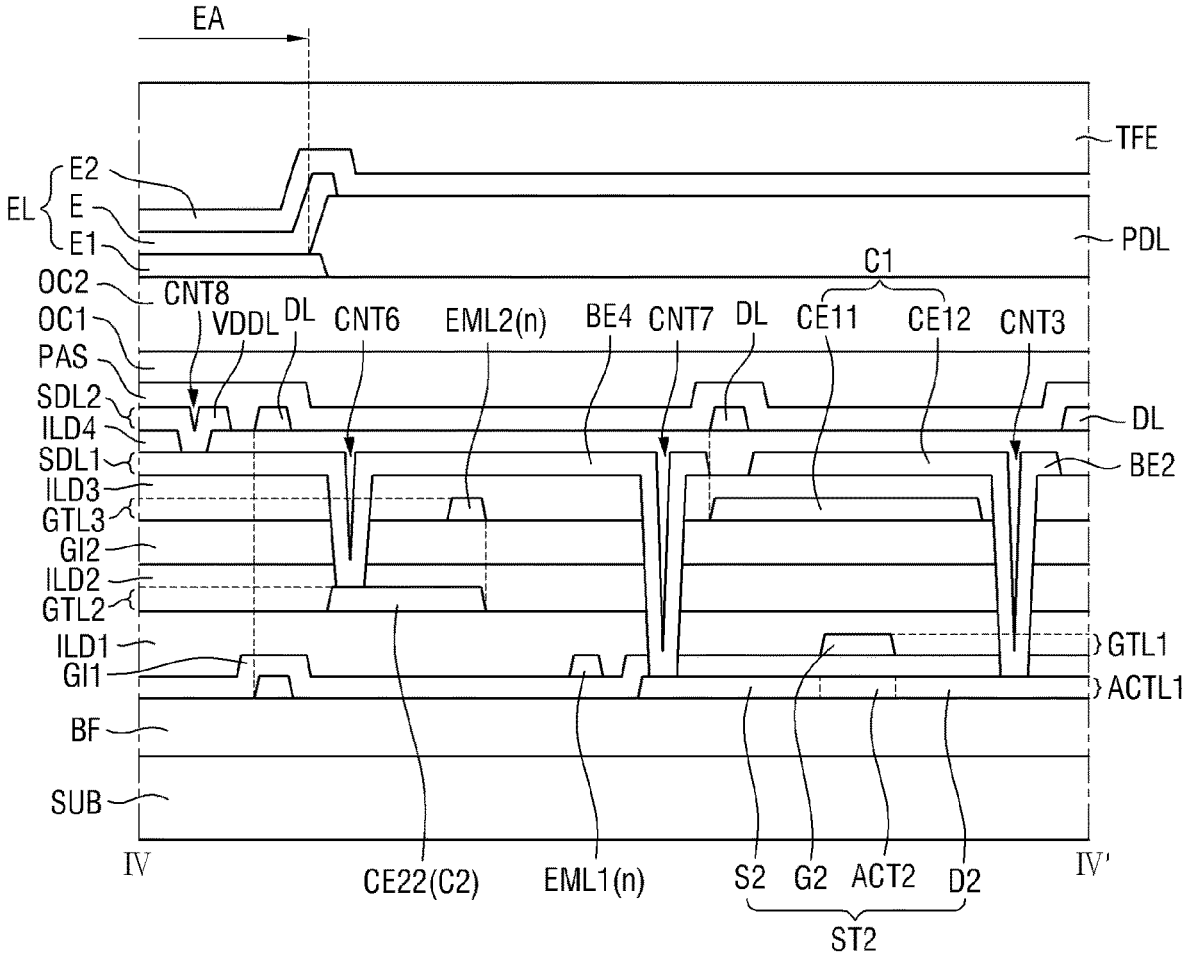
FIG. 16 is a cross-sectional view taken along the line IV-IV' of FIG. 13.

FIG. 13 is a plan view showing another example of the sub-pixel shown in FIG. 5, FIG. 14 is a plan view showing some layers of the sub-pixel shown in FIG. 13, FIG. 15 is a plan view showing some others of the layers of the sub-pixel shown in FIG. 13, and FIG. 16 is a cross-sectional view taken along the line IV-IV' of FIG. 13. FIG. 13 shows a stack of a first active layer, a first gate layer, a second gate layer, a second active layer, a third gate layer, a first source-drain layer, and a second source-drain layer in this order. FIG. 14 shows a stack of the first active layer, the first gate layer, and the second gate layer in this order. FIG. 15 shows a stack of the second active layer, the third gate layer, the first source-drain layer, and the second source-drain layer in this order. The sub-pixel shown in FIGS. 13 to 16 is substantially identical to the sub-pixel described above except for the layout of the first electrode CE11 and the second electrode CE12 of the first capacitor C1; and, therefore, redundant description of features will be omitted.

Referring to FIGS. 13 to 16, a first capacitor C1 may be connected between an emission control line EML(n) and a source electrode DT_S of a driving transistor DT. The first capacitor C1 may include a first electrode CE11 and a second electrode CE12. The first electrode CE11 of the first capacitor C1 may be a part of the second emission control line EML2(*n*) disposed in the third gate layer GTL3 that overlaps the second electrode CE12 of the first capacitor C1.

The second electrode CE12 of the first capacitor C1 may be a part of the second connection electrode BE2 disposed in the first source-drain layer SDL1 that overlaps the first electrode CE11 of the first capacitor C1. The second connection electrode BE2 may be connected to the source electrode DT_S of the driving transistor DT and the drain electrode D2 of the second transistor ST2 disposed in the first active layer ACTL1 through the third contact opening CNT3.

Accordingly, the first capacitor C1 stores the difference in voltage between the emission control line EML(n) and the source electrode DT_S of the driving transistor DT, and thus, it is possible to control the voltage at the source electrode DT_S of the driving transistor DT even when the driving frequency is changed, to thereby prevent (or substantially prevent) flicker and/or ghost images.

Figure 17:
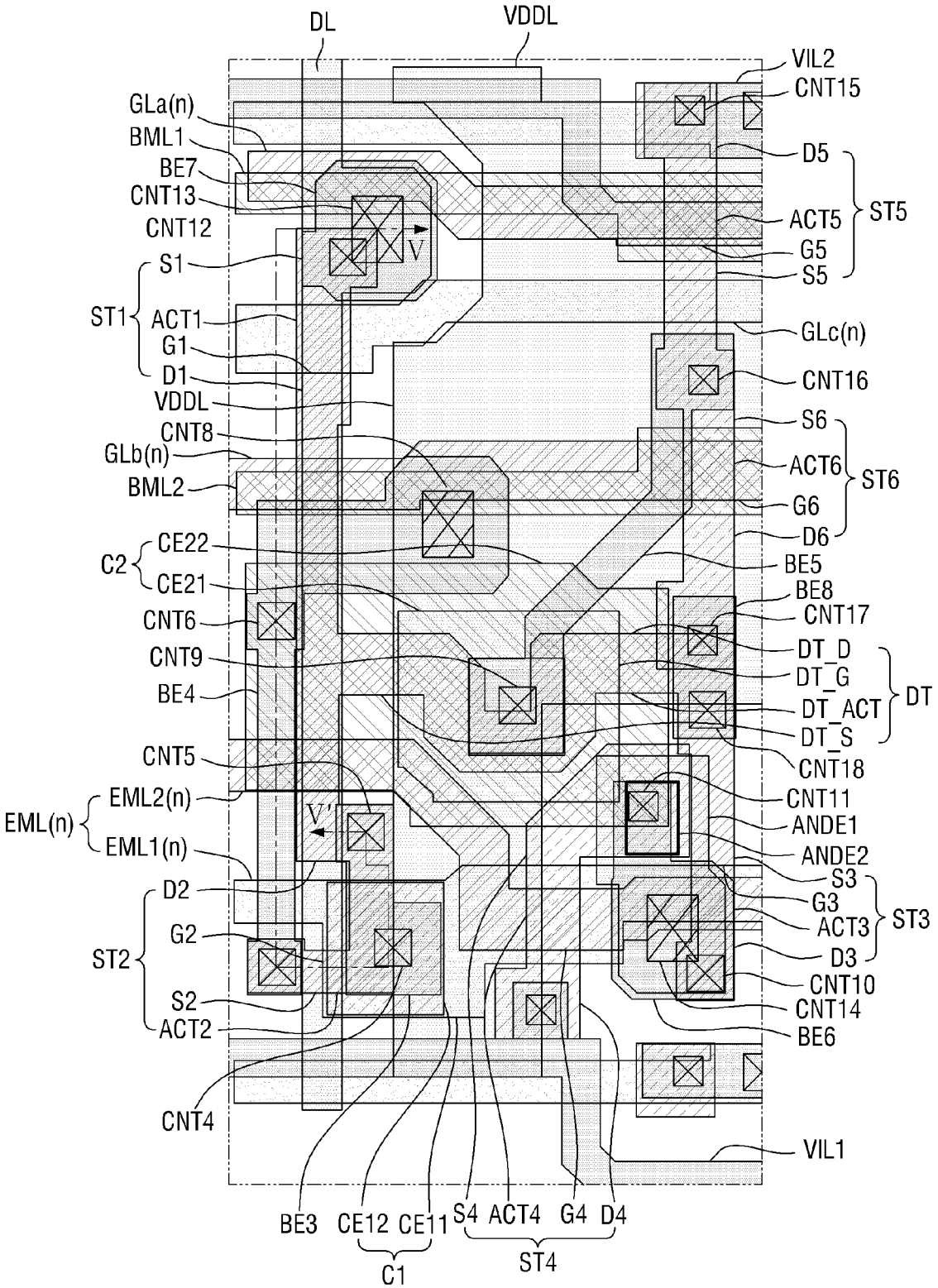
FIG. 17 is a plan view showing yet another example of the sub-pixel shown in FIG. 5.
Figure 18:
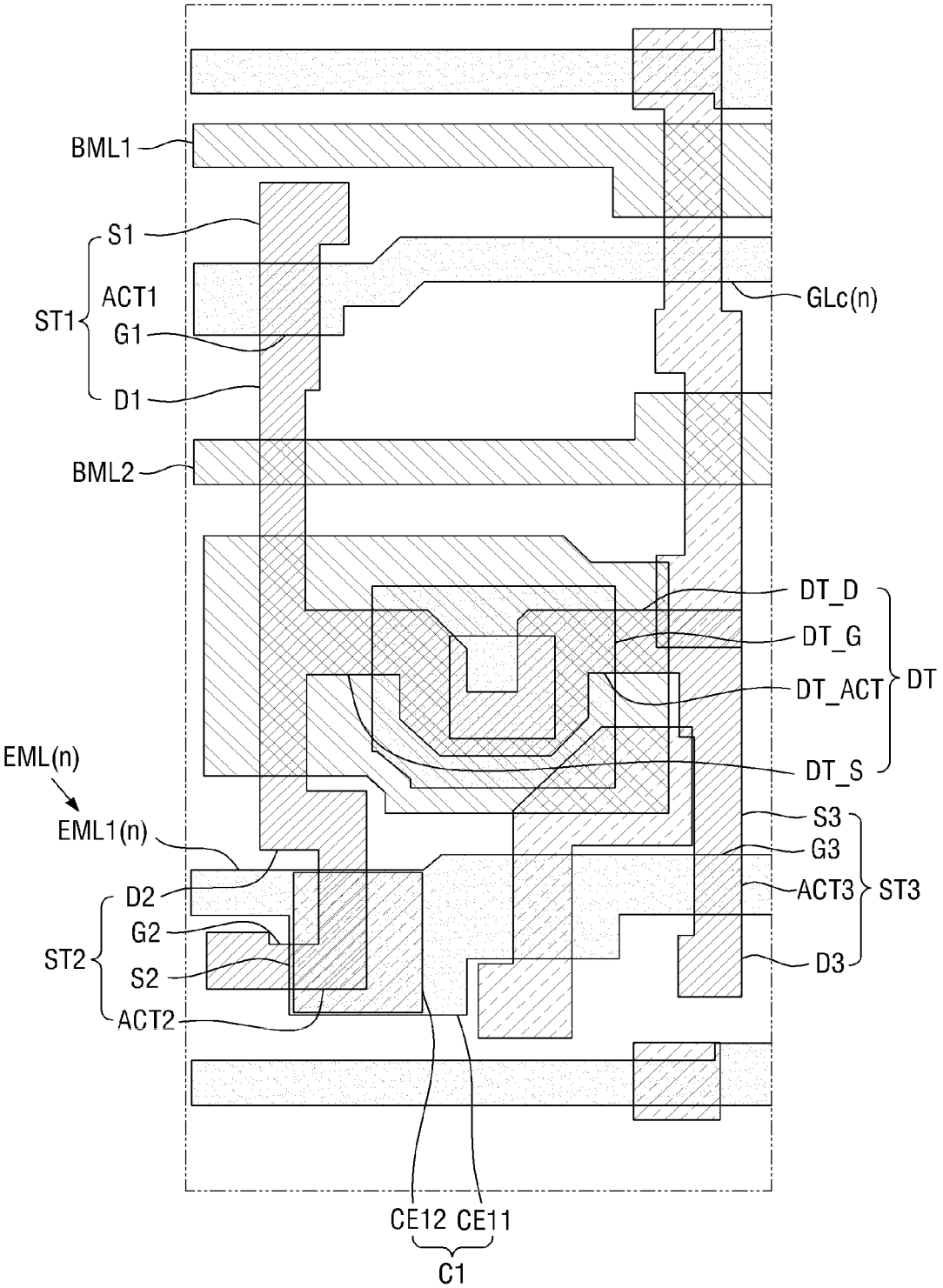
FIG. 18 is a plan view showing some of the layers of the sub-pixel shown in FIG. 17.
Figure 19:
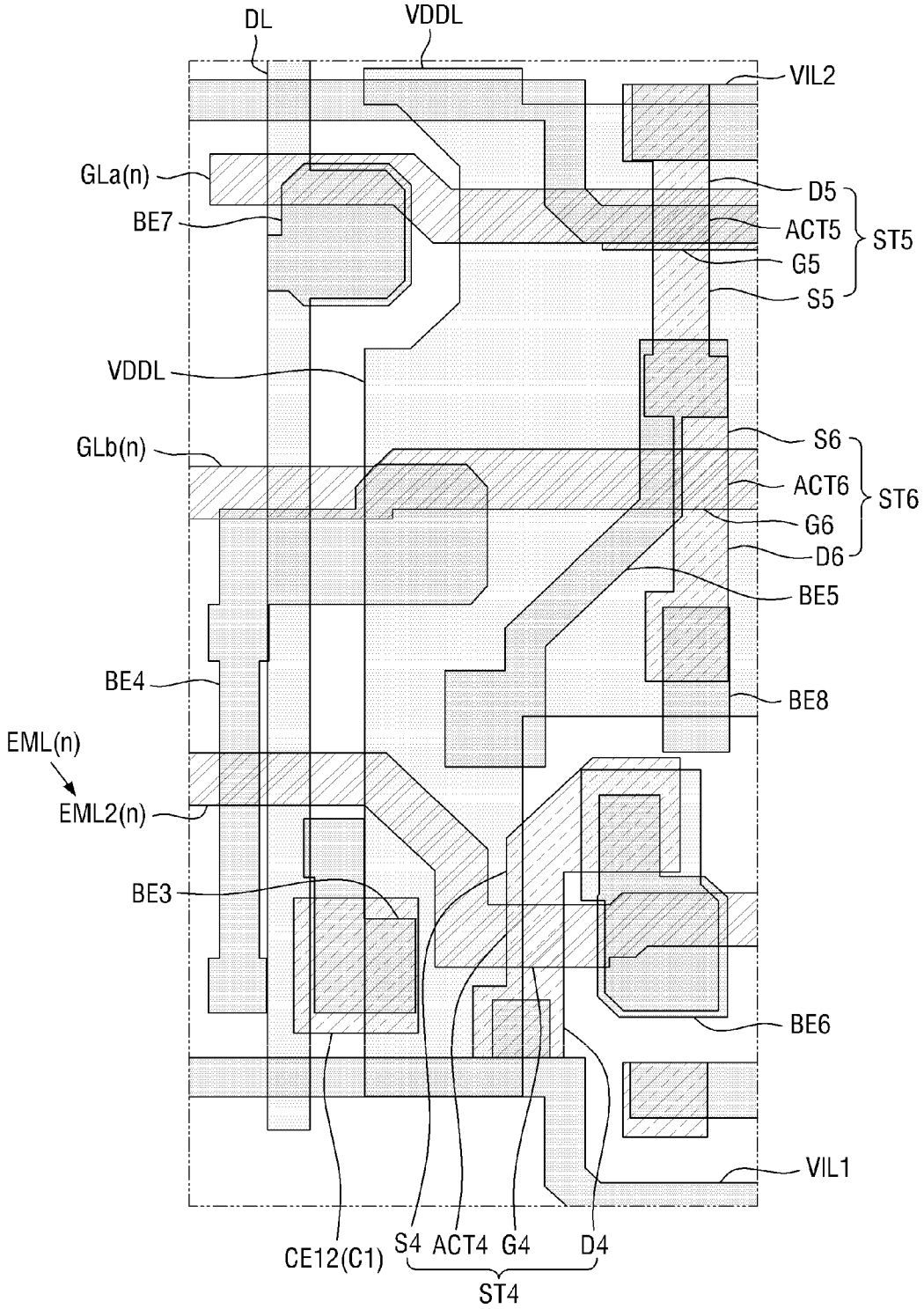
FIG. 19 is a plan view showing some others of the layers of the sub-pixel shown in FIG. 17.
Figure 20:
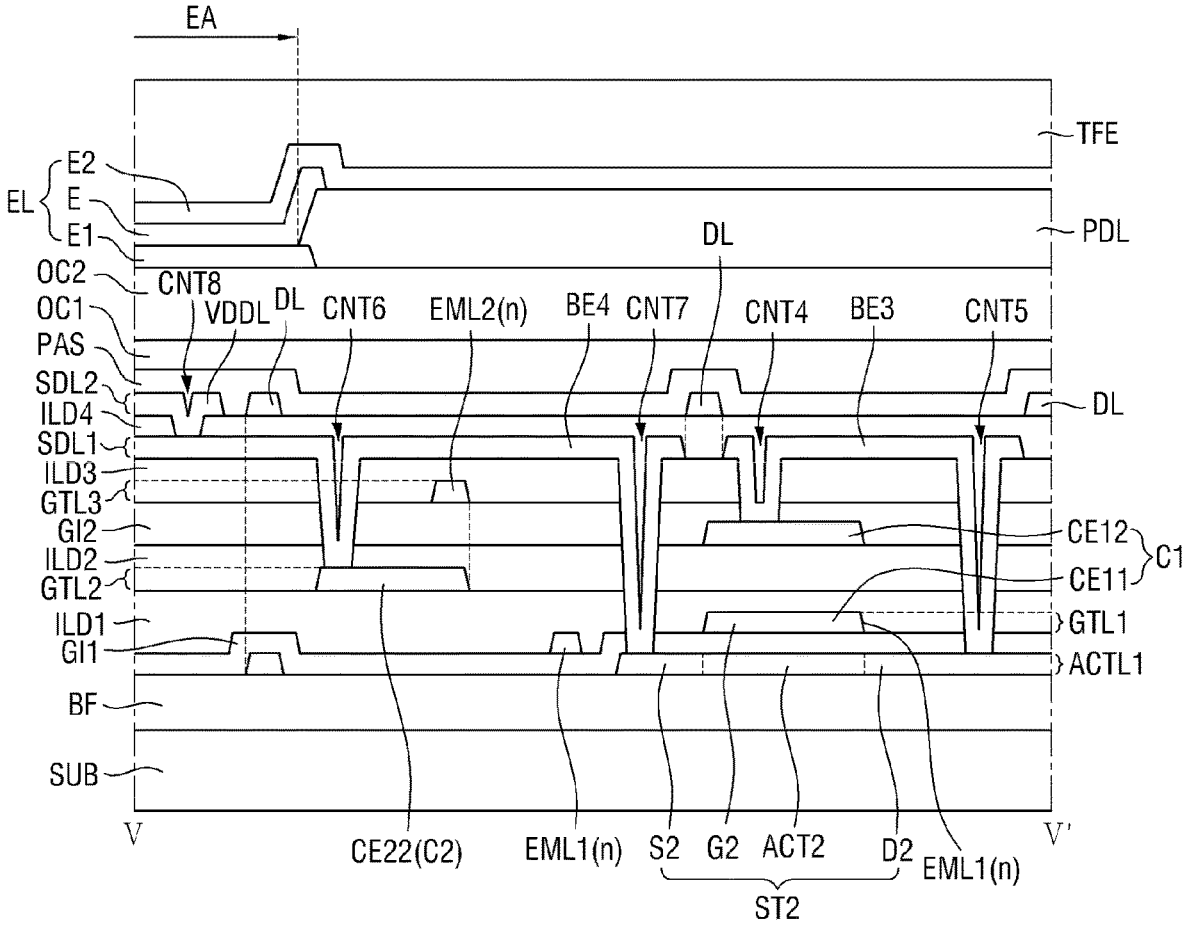
FIG. 20 is a cross-sectional view, taken along the line V-V of FIG. 17.

FIG. 17 is a plan view showing yet another example of the sub-pixel shown in FIG. 5, FIG. 18 is a plan view showing some of the layers of the sub-pixel shown in FIG. 17, FIG. 19 is a plan view showing some others of the layers of the sub-pixel shown in FIG. 17, and FIG. 20 is a cross-sectional view taken along the line V-V' of FIG. 17. FIG. 17 shows a stack of a first active layer, a first gate layer, a second gate layer, a second active layer, a third gate layer, a first source-drain layer, and a second source-drain layer in this order. FIG. 18 shows a stack of the first active layer, the first gate layer, the second gate layer, and the second active layer in this order. FIG. 19 shows a stack of the second active layer, the third gate layer, the first source-drain layer, and the second source-drain layer in this order. The sub-pixel shown in FIGS. 17 to 20 is substantially identical to the sub-pixel described above with respect to FIG. 5 except for the layout of the first electrode CE11 and the second electrode CE12 of the first capacitor C1; and therefore, a redundant description of features will be omitted.

Referring to FIGS. 17 to 20, a first capacitor C1 may be connected between an emission control line EML(n) and a source electrode DT_S of a driving transistor DT. The first capacitor C1 may include a first electrode CE11 and a second electrode CE12. The first electrode CE11 of the first capacitor C1 may be a part of the first emission control line EML1(*n*) disposed in the first gate layer GTL1 that overlaps the second electrode CE12 of the first capacitor C1.

The second electrode CE12 of the first capacitor C1 may be disposed in the second active layer ACTL2. The second electrode CE12 of the first capacitor C1 may be connected to the third connection electrode BE3 of the first source-drain layer SDL1 through the fourth contact opening CNT4, and the third connection electrode BE3 may be connected to the source electrode DT_S of the driving transistor DT disposed in the first active layer ACTL1 and the drain electrode D2 of the second transistor ST2 through the fifth contact opening CNT5.

Accordingly, the first capacitor C1 stores the difference in voltage between the emission control line EML(n) and the source electrode DT_S of the driving transistor DT, and thus, it is possible to control the voltage at the source electrode DT_S of the driving transistor DT to thereby prevent (or substantially prevent) flicker and/or ghost images.

Figure 21:
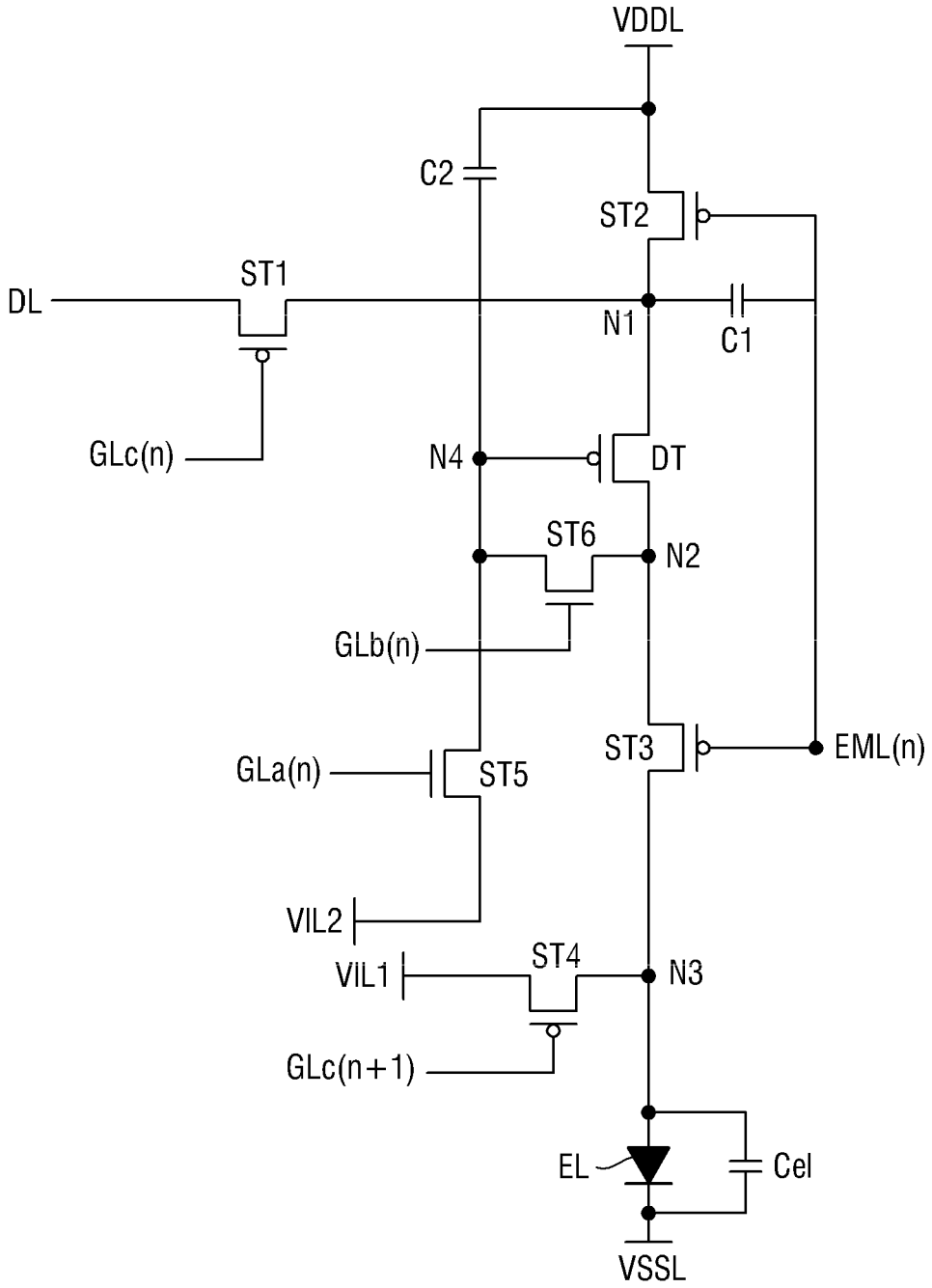
FIG. 21 is a circuit diagram showing a sub-pixel according to another exemplary embodiment of the present disclosure.
Figure 22:
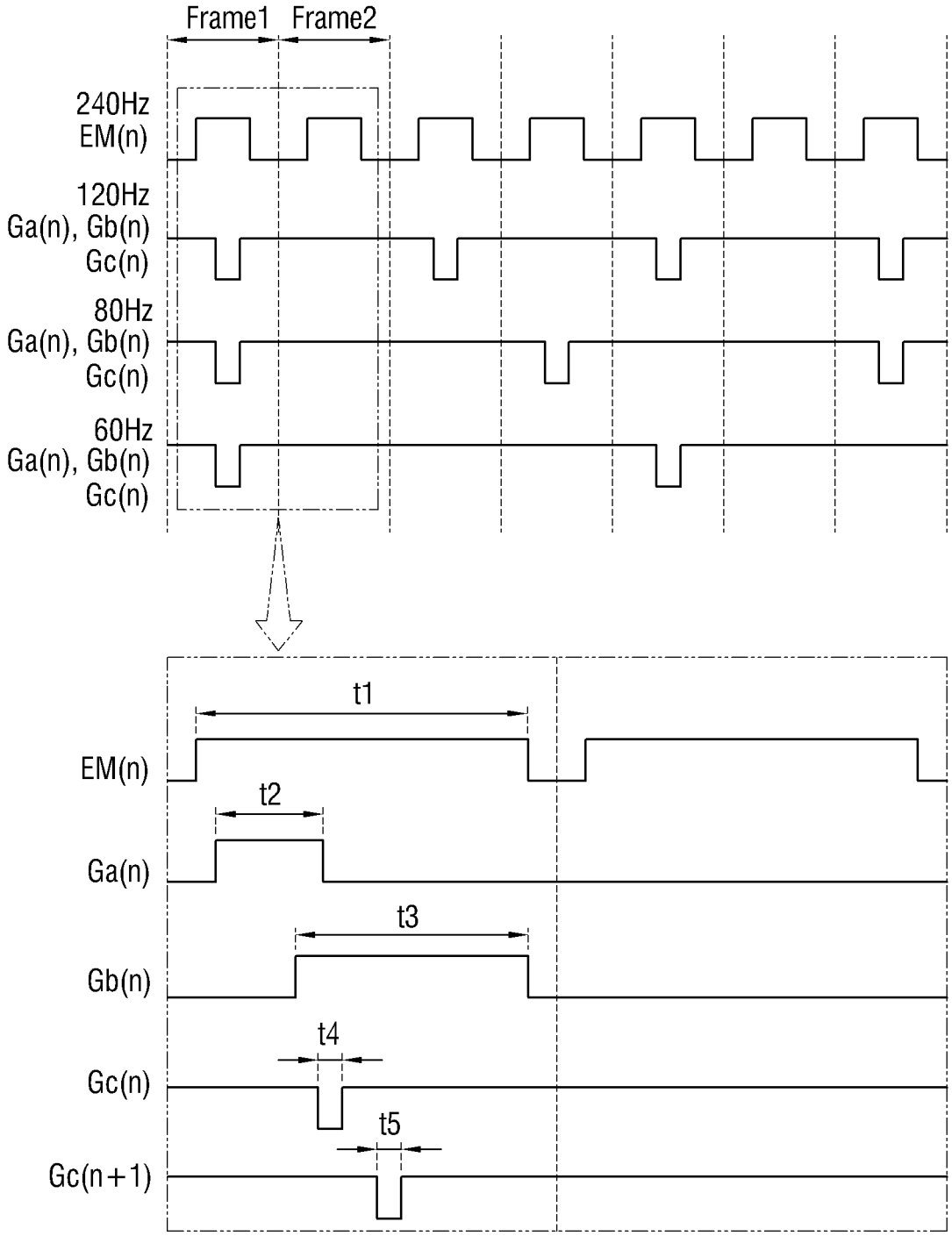
FIG. 22 is a waveform diagram of signals supplied to the sub-pixel shown in FIG. 21.

FIG. 21 is a circuit diagram showing a sub-pixel according to another exemplary embodiment of the present disclosure, And FIG. 22 is a waveform diagram of signals supplied to the sub-pixel shown in FIG. 21. The sub-pixel described with respect to FIGS. 21 and 22 is substantially identical to the sub-pixel described above except that different signals are applied to a gate electrode G4 of a fourth transistor ST4; and therefore, a redundant description of features will be omitted.

Referring to FIGS. 21 and 22, the display panel 300 may include a plurality of sub-pixels arranged along p rows and q columns, where p and q are natural numbers. A sub-pixel disposed in $n^{th}$ row and $m^{th}$ column may be connected to a first scan line GLa(n), a second scan line GLb(n), and a third scan line GLc(n), an emission control line EML(n), a data line DL, a driving voltage line VDDL, and first and second initialization voltage lines VIL1 and VIL2, where n is a natural number equal to or less than p, and m is a natural number equal to or less than q.

The sub-pixel SP may include a driving transistor DT, a light-emitting element EL, a plurality of switching elements, and first and second capacitors C1 and C2. The switching elements may include first to sixth transistors ST1, ST2, ST3, ST4, ST5, and ST6.

The light-emitting element EL may receive a driving current to emit light. The amount or the brightness of the light emitted from the light-emitting element EL may be proportional to the magnitude of the driving current. The anode electrode of the light-emitting element EL may be connected to a third node N3. The anode electrode of the light-emitting element EL may be connected to the drain electrode of the third transistor ST3 and the source electrode of the fourth transistor T4 through the third node N3. The cathode electrode of the light-emitting element EL may be connected to the low-level line VSSL.

The first transistor ST1 may be turned on by a third scan signal Gc(n) of the third scan line GLc(n) and may supply the data voltage Vdata to a first node N1, i.e., the source electrode of the driving transistor DT.

The second transistor ST2 may be turned on by an emission signal EM(n) of the emission control line EML(n) and may apply the driving voltage line VDDL to the first node N1, i.e., the source electrode of the driving transistor DT.

The third transistor ST3 may be turned on by the emission signal EM(n) of the emission control line EML(n) to connect the second node N2, i.e., the drain electrode of the driving transistor DT with the third node N3, i.e., the anode electrode of the light-emitting element EL.

The fourth transistor ST4 may be turned on by a fourth scan signal Gc(n+1) of the fourth scan line GLc(n+1) and may supply the first initialization voltage VI1 to the third node N3, i.e., the anode electrode of the light-emitting element EL.

The fifth transistor ST5 may be turned on by the first scan signal Ga(n) of the first scan line GLa(n) and may apply the second initialization voltage line VIL2 to the fourth node N4, i.e., the gate electrode of the driving transistor DT.

The sixth transistor ST6 may be turned on by the second scan signal Gb(n) of the second scan line GLb(n) to connect the second node N2, i.e., the drain electrode of the driving transistor DT, with the fourth node N4, i.e., the gate electrode of the driving transistor DT.

Each of the driving transistor DT and the first to fourth transistors ST1, ST2, ST3, and ST4 may include a silicon-based active layer. For example, each of the driving transistor DT and the first to fourth transistors ST1, ST2, ST3, and ST4 may include an active layer made of low-temperature polycrystalline silicon (LTPS).

Each of the fifth and sixth transistors ST5 and ST6 may include an oxide-based active layer. For example, each of the fifth and sixth transistors ST5 and ST6 may have a coplanar structure in which a gate electrode is disposed above an oxide-based active layer.

The first capacitor C1 may be connected between the emission control line EML(n) and the first node N1. For example, the first electrode CE11 of the first capacitor C1 may be connected to the emission control line EML(n), and the second electrode CE12 of the first capacitor C1 may be connected to the first node N1, i.e., the source electrode of the driving transistor DT. The first capacitor C1 stores the difference in voltage between the emission control line EML(n) and the source electrode of the driving transistor DT so that the source electrode of the driving transistor DT controls the voltage.

The first capacitor C1 may couple a source electrode DT_S of the driving transistor DT by using a gate-off voltage of the emission signal EM(n). For example, when the emission signal EM(n) provided from the emission control line EML (n) rises, the first capacitor C1 may increase the voltage at the first node N1, and when the emission signal EM(n) falls, it may decrease the voltage at the first node N1. Accordingly, the first capacitor C1 controls the voltage at the source electrode of the driving transistor DT in synchronization with the rising or falling edge of the emission signal EM(n).

Figure 23:
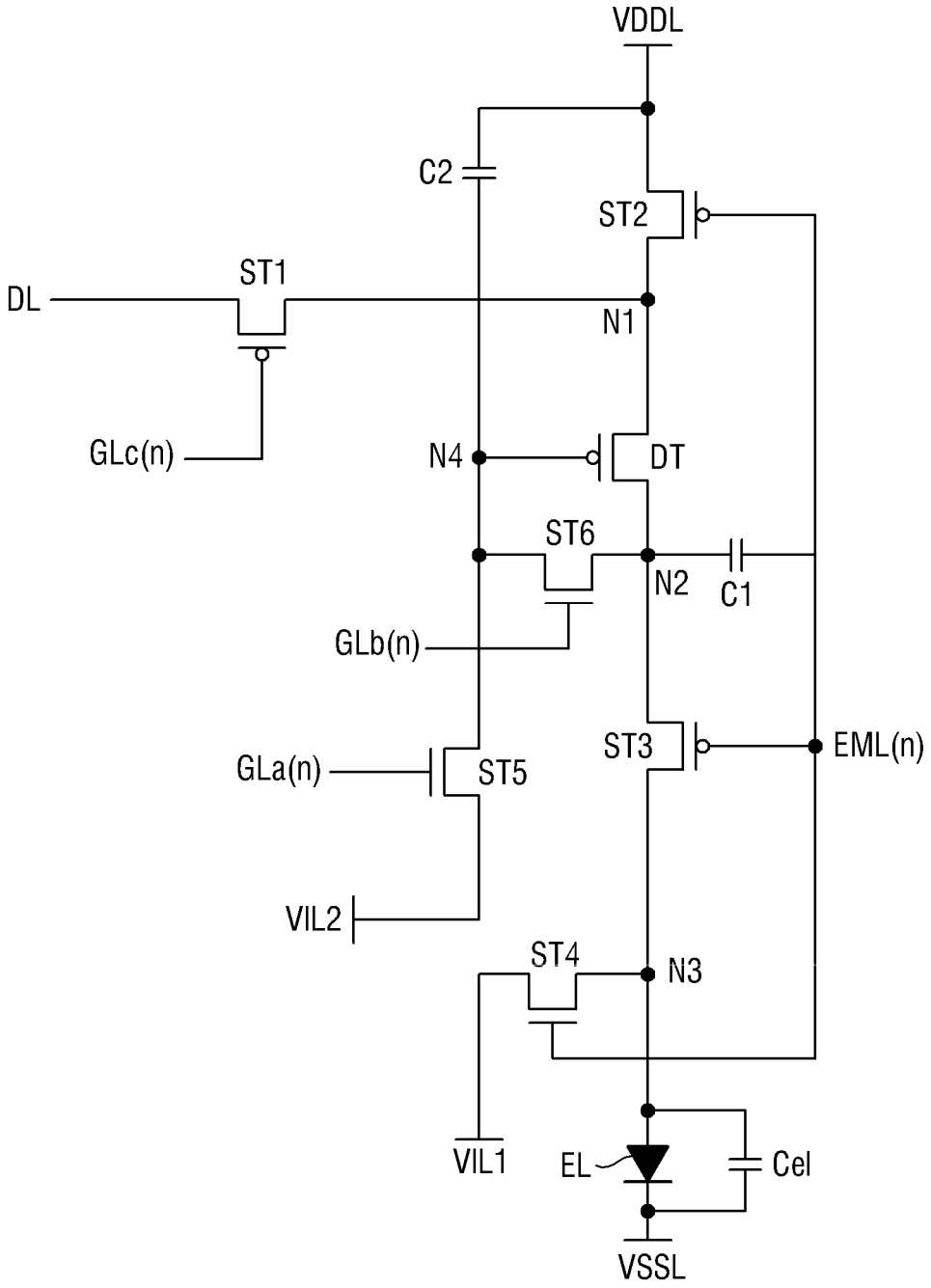
FIG. 23 is a circuit diagram showing a sub-pixel according to yet another exemplary embodiment of the present disclosure.

FIG. 23 is a circuit diagram showing a sub-pixel according to yet another exemplary embodiment of the present disclosure. The sub-pixel shown in FIG. 23 is substantially identical to the sub-pixel shown in FIG. 5 except that a first capacitor C1 is connected to a different position; and therefore, a redundant description of features will be omitted.

Referring to FIG. 23, the sub-pixel SP may include a driving transistor DT, a light-emitting element EL, a plurality of switching elements, and first and second capacitors C1 and C2. The switching elements may include first to sixth transistors ST1, ST2, ST3, ST4, ST5, and ST6.

The light-emitting element EL may receive a driving current to emit light. The amount or the brightness of the light emitted from the light-emitting element EL may be proportional to the magnitude of the driving current. The anode electrode of the light-emitting element EL may be connected to a third node N3. The anode electrode of the light-emitting element EL may be connected to the drain electrode of the third transistor ST3 and the source electrode of the fourth transistor T4 through the third node N3. The cathode electrode of the light-emitting element EL may be connected to the low-level line VSSL.

The first transistor ST1 may be turned on by a third scan signal Gc(n) of the third scan line GLc(n) and may supply the data voltage Vdata to a first node N1, i.e., the source electrode of the driving transistor DT.

The second transistor ST2 may be turned on by an emission signal EM(n) of the emission control line EML(n) and may apply the driving voltage line VDDL to the first node N1, i.e., the source electrode of the driving transistor DT.

The third transistor ST3 may be turned on by the emission signal EM(n) of the emission control line EML(n) to connect the second node N2, i.e., the drain electrode of the driving transistor DT, with the third node N3, i.e., the anode electrode of the light-emitting element EL.

The fourth transistor ST4 may be turned on by the emission signal EM(n) of the emission control line EML(n) to apply the first initialization voltage line VIL1 to the third node N3, i.e., the anode electrode of the light-emitting element EL.

The fifth transistor ST5 may be turned on by the first scan signal Ga(n) of the first scan line GLa(n) and may apply the second initialization voltage line VIL2 to the fourth node N4, i.e., the gate electrode of the driving transistor DT.

The sixth transistor ST6 may be turned on by the second scan signal Gb(n) of the second scan line GLb(n) to connect the second node N2, i.e., the drain electrode of the driving transistor DT, with the fourth node N4, i.e., the gate electrode of the driving transistor DT.

The first capacitor C1 may be connected between the emission control line EML(n) and the second node N2. For example, the first electrode CE11 of the first capacitor C1 may be connected to the emission control line EML(n), and the second electrode CE12 of the first capacitor C1 may be connected to the first node N1, i.e., the drain electrode of the driving transistor DT. The first capacitor C1 stores the difference in voltage between the emission control line EML(n) and the drain electrode of the driving transistor DT so that the drain electrode of the driving transistor DT controls the voltage.

The first capacitor C1 may couple a drain electrode DT_D of the driving transistor DT by using a gate-off voltage of the emission signal EM(n). For example, when the emission signal EM(n) provided from the emission control line EML (n) rises, the first capacitor C1 may increase the voltage at the second node N2, and when the emission signal EM(n) falls, it may decrease the voltage at the second node N2. In such case, the driving transistor DT may be turned on by receiving the gate-on voltage, and the voltage at the drain electrode of the driving transistor DT may be transferred to the source electrode. Accordingly, the first capacitor C1 can control the voltage at the drain electrode and the source electrode of the driving transistor DT in synchronization with the rising or falling edge of the emission signal EM(n).

Therefore, even when the driving frequency is changed, the display device can prevent a flicker and/or ghost image by controlling the voltage at the source electrode of the driving transistor.

Figure 24:
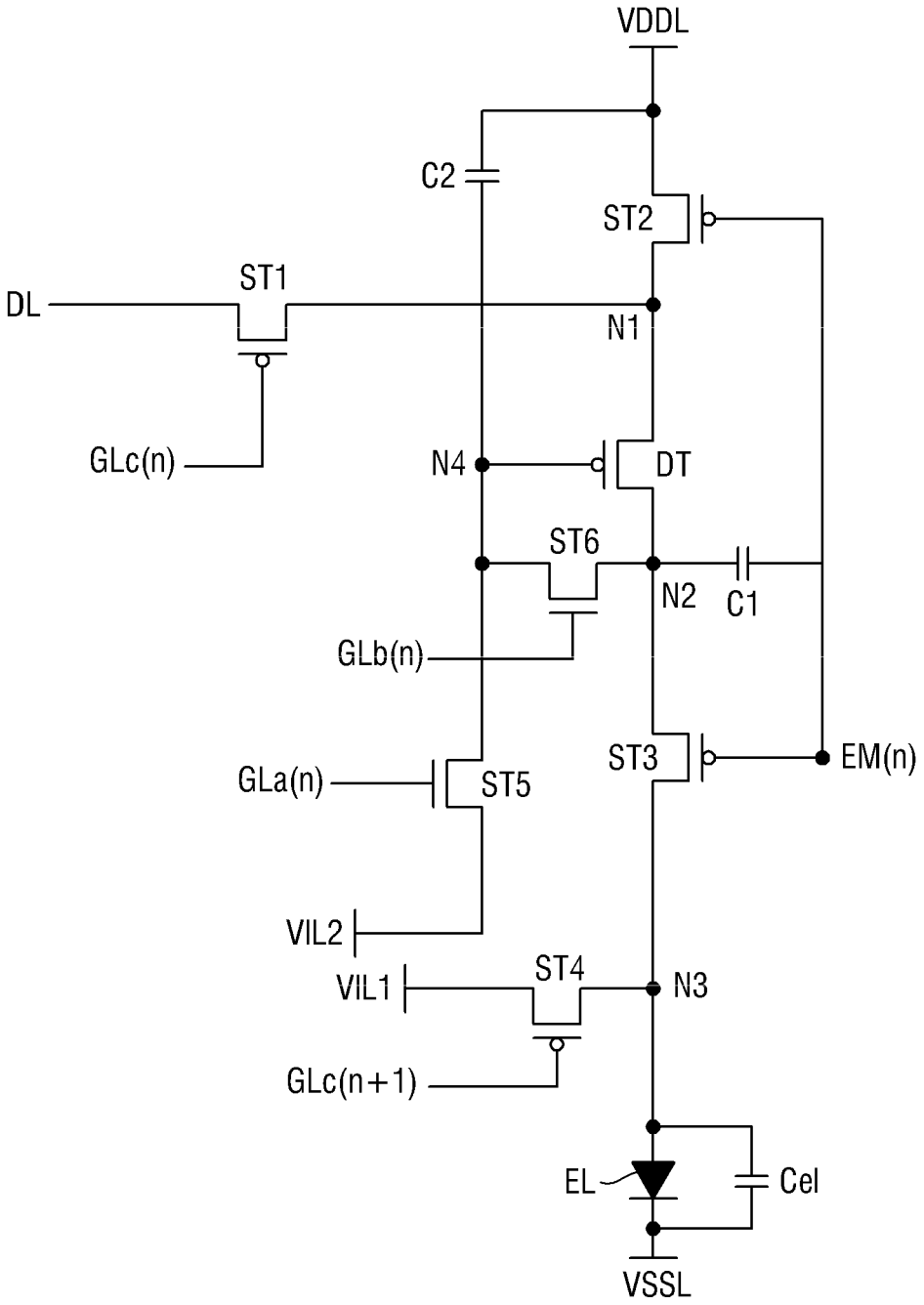
FIG. 24 is a circuit diagram showing a sub-pixel according to yet another exemplary embodiment of the present disclosure.

FIG. 24 is a circuit diagram showing a sub-pixel according to yet another exemplary embodiment of the present disclosure. The sub-pixel of FIG. 24 is substantially identical to the sub-pixel shown in FIG. 23 except that different signals are applied to a gate electrode G4 of a fourth transistor ST4; and therefore, a redundant description of features will be omitted.

The sub-pixel SP may include a driving transistor DT, a light-emitting element EL, a plurality of switching elements, and first and second capacitors C1 and C2. The switching elements may include first to sixth transistors ST1, ST2, ST3, ST4, ST5, and ST6.

The fourth transistor ST4 may be turned on by a fourth scan signal Gc(n+1) of the fourth scan line GLc(n+1) and may supply the first initialization voltage VI1 to the third node N3, i.e., the anode electrode of the light-emitting element EL.

Each of the driving transistor DT and the first to fourth transistors ST1, ST2, ST3, and ST4 may include a silicon-based active layer. For example, each of the driving transistor DT and the first to fourth transistors ST1, ST2, ST3, and ST4 may include an active layer made of low-temperature polycrystalline silicon (LTPS).

Each of the fifth and sixth transistors ST5 and ST6 may include an oxide-based active layer. For example, each of the fifth and sixth transistors ST5 and ST6 may have a coplanar structure in which a gate electrode is disposed above an oxide-based active layer.

The present disclosure is not limited to the aspects, features, and exemplary (i.e., example) embodiments described above, and various other aspects, features, and embodiments are included in this specification.

Although exemplary embodiments of the present disclosure have been described with reference to the accompanying drawings, those skilled in the art will appreciate that various modifications and alterations may be made therein without departing from the spirit or essential feature of the present disclosure. Therefore, the above embodiments are to be regarded as being illustrative rather than restrictive. The present disclosure is to be defined based on the appended claims and their equivalents.

What is claimed is:

1. A display device comprising a display panel for driving a plurality of pixels, each of the plurality of pixels comprising:

a light-emitting element;

a driving transistor for controlling a driving current flowing through the light-emitting element;

a first transistor for selectively applying a data voltage to a first node, the first node being a source electrode of the driving transistor;

a second transistor for receiving an emission signal from an emission control line to selectively apply a driving voltage to the first node;

a third transistor for selectively connecting a second node with a third node, the second node being a drain electrode of the driving transistor, the third node being an anode electrode of the light-emitting element;

a fourth transistor for selectively applying a first initialization voltage from a first initialization voltage line to the third node;

a fifth transistor for selectively applying a second initialization voltage from a second initialization voltage line to a fourth node, the fourth node being a gate electrode of the driving transistor;

a sixth transistor for selectively connecting the second node with the fourth node; and a first capacitor directly connected between the first node and the emission control line.

2. The display device of claim 1, wherein the second transistor and the third transistor are turned on in response to the emission signal having a first voltage level, and wherein the fourth transistor is turned on in response to the emission signal having a second voltage level that is higher than the first voltage level.

3. The display device of claim 1, wherein the driving transistor comprises an active layer comprising a first material, and wherein the fourth transistor comprises an active layer comprising a second material different from the first material.

4. The display device of claim 1, wherein each of the driving transistor and the fourth transistor comprises an active layer comprising a first material, and wherein each of the fifth and sixth transistors comprises an active layer comprising a second material different from the first material.

5. A display device comprising a display panel for driving a plurality of pixels, each of the plurality of pixels comprising:

a light-emitting element;

a driving transistor for controlling a driving current flowing through the light-emitting element;

a first transistor for selectively applying a data voltage to a first node, the first node being a source electrode of the driving transistor;

a second transistor for receiving an emission signal from an emission control line to selectively apply a driving voltage to the first node; and a first capacitor connected between the first node and the emission control line, wherein the display panel comprises:

a first active layer on a substrate and comprising a first material;

a first gate layer on the first active layer;

a second gate layer on the first gate layer;

a second active layer on the second gate layer and comprising a second material different from the first material;

a third gate layer on the second active layer; and a first source-drain layer on the third gate layer.

6. The display device of claim 5, wherein a first electrode of the first capacitor is in the first gate layer, and wherein a second electrode of the first capacitor is in the second gate layer.

7. The display device of claim 6, wherein the display panel further comprises a first connection electrode, and wherein the first connection electrode is in the first source-drain layer, is connected to the second electrode of the first capacitor through a first contact opening, and is connected to the first node through a second contact opening, the first node also being a drain electrode of the second transistor.

8. The display device of claim 6, wherein the emission control line comprises:

a first emission control line in the first gate layer; and a second emission control line in the third gate layer, and wherein the first electrode of the first capacitor is a part of the first emission control line that overlaps the second electrode.

9. The display device of claim 5, wherein a first electrode of the first capacitor is in the third gate layer, and wherein a second electrode of the first capacitor is in the first source-drain layer.

10. The display device of claim 9, wherein the display panel further comprises a first connection electrode, and wherein the first connection electrode is in the first source-drain layer and is connected to the first node through a first contact opening, the first node also being a drain electrode of the second transistor.

11. The display device of claim 9, wherein the emission control line comprises:

a first emission control line in the first gate layer; and a second emission control line in the third gate layer, and wherein the first electrode of the first capacitor is a part of the second emission control line that overlaps the second electrode.

12. The display device of claim 5, wherein a first electrode of the first capacitor is in the first gate layer, and wherein a second electrode of the first capacitor is in the second active layer.

13. The display device of claim 12, wherein the display panel further comprises a first connection electrode, and wherein the first connection electrode is in the first source-drain layer, is connected to the second electrode of the first capacitor through a first contact opening, and is connected to the first node through a second contact opening, the first node also being a drain electrode of the second transistor.

14. The display device of claim 12, wherein the emission control line comprises:

a first emission control line in the first gate layer; and a second emission control line in the third gate layer, and wherein the first electrode of the first capacitor is a part of the first emission control line that overlaps the second electrode.

15. A display device comprising a display panel for driving a plurality of pixels, each of the plurality of pixels comprising:

a light-emitting element;

a driving transistor for controlling a driving current flowing through the light-emitting element;

a first transistor for selectively applying a data voltage to a first node, the first node being a source electrode of the driving transistor;

a second transistor for receiving an emission signal from an emission control line to selectively apply a driving voltage to the first node;

a third transistor for receiving the emission signal to selectively connect a second node with a third node, the second node being a drain electrode of the driving transistor, the third node being an anode electrode of the light-emitting element; and a first capacitor connected between the second node and the emission control line, the first capacitor being configured to store a difference in voltage between the emission control line and the second node.

16. The display device of claim 15, wherein each of the plurality of pixels further comprises:

a fourth transistor for selectively applying a first initialization voltage to the third node;

a fifth transistor for selectively applying a second initialization voltage to a fourth node, the fourth node being a gate electrode of the driving transistor; and a sixth transistor for selectively connecting the second node with the fourth node.

17. The display device of claim 16, wherein the second transistor and the third transistor are turned on in response to the emission signal having a first voltage level, and wherein the fourth transistor is turned on in response to the emission signal having a second voltage level that is higher than the first voltage level.

18. The display device of claim 16, wherein each of the driving transistor and the fourth transistor comprises an active layer comprising a first material, and wherein each of the fifth and sixth transistors comprises an active layer comprising a second material different from the first material.

* * * * *